US012257666B2

(12) United States Patent
Shinozaki et al.

(10) Patent No.: US 12,257,666 B2
(45) Date of Patent: Mar. 25, 2025

(54) SURFACE HEIGHT MEASUREMENT METHOD USING DUMMY DISK

(71) Applicant: EBARA CORPORATION, Tokyo (JP)

(72) Inventors: Hiroyuki Shinozaki, Tokyo (JP); Yasuyuki Motoshima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/466,002

(22) Filed: Sep. 13, 2023

(65) Prior Publication Data

US 2023/0415299 A1 Dec. 28, 2023

Related U.S. Application Data

(62) Division of application No. 16/708,388, filed on Dec. 9, 2019, now abandoned.

(30) Foreign Application Priority Data

Jan. 31, 2019 (JP) ..... 2019-015564

(51) Int. Cl.

| | |
|---|---|
| ***B24B 17/08*** | (2006.01) |
| ***B24B 1/04*** | (2006.01) |
| ***B24B 37/005*** | (2012.01) |
| ***B24B 37/07*** | (2012.01) |
| ***B24B 37/10*** | (2012.01) |
| ***B24B 37/16*** | (2012.01) |

(Continued)

(52) U.S. Cl.

CPC ..... *B24B 37/16* (2013.01); *B24B 1/04* (2013.01); *B24B 17/08* (2013.01); *B24B 37/005* (2013.01); *B24B 37/07* (2013.01); *B24B 37/10* (2013.01); *B24B 37/26* (2013.01); *B24B 53/017* (2013.01); *B24B 53/12* (2013.01)

(58) Field of Classification Search

CPC ..... B24B 49/04; B24B 49/02; B24B 49/12; B24B 49/18; B24B 53/017; B24B 53/08; B24B 37/005; B24B 37/20; B24B 37/12; B24B 37/013; B24B 37/04

See application file for complete search history.

(56) References Cited

U.S. PATENT DOCUMENTS 6,165,056 A * 12/2000 Hayashi ..... B24B 41/068 451/550
6,905,398 B2 * 6/2005 Jeong ..... B24B 41/047 451/259

(Continued)

FOREIGN PATENT DOCUMENTS

| | | |
|---|---|---|
| CN | 103659605 | 8/2017 |
| JP | 2001219376 | 8/2001 |

(Continued)

OTHER PUBLICATIONS

KR-20160115369-A English Translation (Year: 2016).*

*Primary Examiner* — Makena S Markman
(74) *Attorney, Agent, or Firm* — JCIPRNET

(57) ABSTRACT

A method is provided and includes making a polishing table and a dummy disk rotate; bringing the dummy disk into contact with a table surface of the polishing table while a liquid is supplied to the table surface; measuring heights of the table surface at a plurality of measurement points while the dummy disk is moved on the table surface; and creating a table profile showing tilt of the table surface from measurement values of the heights of the table surface.

4 Claims, 15 Drawing Sheets

(51) Int. Cl.

| | |
|---|---|
| ***B24B 37/26*** | (2012.01) |
| ***B24B 53/017*** | (2012.01) |
| ***B24B 53/12*** | (2006.01) |

(56) References Cited

U.S. PATENT DOCUMENTS

| | | | | |
|---|---|---|---|---|
| 7,731,569 | B2 | 6/2010 | Fujita | |
| 8,382,558 | B2 * | 2/2013 | Watanabe | B24B 53/017 451/288 |
| 9,138,860 | B2 * | 9/2015 | Dhandapani | B24B 37/042 |
| 11,389,928 | B2 * | 7/2022 | Lee | B24B 53/017 |
| 2004/0192168 | A1 * | 9/2004 | Faustmann | B24B 49/16 451/72 |
| 2007/0259609 | A1 | 11/2007 | Iiyoshi et al. | |
| 2012/0083189 | A1 | 4/2012 | Choi et al. | |
| 2012/0309267 | A1 * | 12/2012 | Shinozaki | B24B 37/042 451/8 |
| 2018/0104792 | A1 * | 4/2018 | Hong | B24B 37/042 |

FOREIGN PATENT DOCUMENTS

| | | |
|---|---|---|
| JP | 2003145424 | 5/2003 |
| JP | 2015009295 | 1/2015 |
| JP | 2018171670 | 11/2018 |
| KR | 20120035370 | 4/2012 |
| KR | 20120135080 | 12/2012 |
| KR | 20160115369 A * | 10/2016 |
| TW | 201532735 | 9/2015 |
| TW | I605908 | 11/2017 |

* cited by examiner

SURFACE HEIGHT MEASUREMENT METHOD USING DUMMY DISK

CROSS-REFERENCE TO RELATED APPLICATION

The present application is a division of U.S. Ser. No. 16/708,388, filed on 2019 Dec. 9, and is related to and claims the priority benefit of Japan application serial no. 2019-015564, filed on 2019 Jan. 31. The entirety of the above-mentioned patent application is hereby incorporated by reference herein and made a part of this specification.

BACKGROUND

Technical Field

The disclosure relates to a dummy disk which is used for height measurement of a table surface of a polishing table built in a polishing device for polishing a substrate such as a wafer, in particular, to a dummy disk which is used in place of a dressing disk of a dresser. In addition, the disclosure relates to a dressing disk which is used for dressing (conditioning) of a polishing pad of a polishing device. Furthermore, the disclosure relates to a method for using the above dummy disk to measure heights of the table surface of the polishing table.

Related Art

While supplying slurry onto a polishing pad affixed to a polishing table, a CMP device relatively moves the polishing pad and a wafer, and thereby a surface of the wafer is chemically and mechanically polished. In order to maintain a polish performance of the polishing pad, it is necessary to periodically dress (also called condition) a polishing surface of the polishing pad by a dresser. The dresser has a dressing surface on which diamond particles are fixed on the entire surface.

The dressing of the polishing pad is performed as below. While the polishing table is rotated along with the polishing pad, a liquid (for example, pure water) is supplied onto the polishing surface. The dresser presses the polishing surface of the polishing pad while rotating around an axis thereof and is moved on the polishing surface in this state. A dressing surface of the dresser slightly scrapes off the polishing surface of the polishing pad, and thereby the polishing surface of the polishing pad is regenerated.

During the polishing of the wafer, the wafer is pressed against the polishing surface of the polishing pad. Therefore, a pad profile showing a height distribution of the polishing surface along a radial direction of the polishing table affects the polishing of the wafer. A thickness of the polishing pad gradually decreases as the dressing of the polishing pad is repeated. On the other hand, maintaining a constant pad profile leads to accurate control of the polishing of the wafer.

Heights of the polishing surface of the polishing pad can be indirectly measured from a height of the dresser (a position in an up-down direction). That is, while the polishing table is rotated along with the polishing pad and the dresser is moved on the polishing surface of the polishing pad, the height of the dresser is measured by a surface height measurement instrument. The height of the dresser (the position in the up-down direction) is changed depending on the heights of the polishing surface. Therefore, a height distribution of the dresser represents the height distribution of the polishing surface, that is, the pad profile.

For example, the known arts can be found such as Japanese Patent Application Laid-Open No. 2012-250309, No. 2010-172996 and No. 2016-144860.

The polishing pad is arranged on the polishing table. Therefore, the pad profile may be changed depending on a table profile showing tilt of the table surface of the polishing table. In order to accurately perform management of the pad profile, it is necessary to (i) create an accurate table profile before the polishing pad is affixed to the table surface, and (ii) create an accurate pad profile after the polishing pad is affixed to the table surface.

The table profile can be obtained as below. Heights of the table surface are measured at a plurality of measurement points in a state that the polishing table is not rotated, and the table profile is created from measurement values of the heights of the table surface. However, the measurement of the heights of the table surface is performed manually by an operator, and thus measurement results may be changed depending on the skill of the operator. As a result, it is hard to obtain stable measurement values of the heights of the table surface.

A process for creating the pad profile during dressing of the polishing pad can be automatically executed using a surface height measurement instrument, and the creation of the pad profile can be completed substantially at the same time when the dressing action ends. However, a liquid (for example, pure water) present on the polishing pad destabilizes a posture of the dresser, and as a result, it is found from test results of the pad dressing that measurement values of a height of the dresser, that is, heights of the polishing surface are inaccurate.

SUMMARY

In one embodiment, a method is provided to include steps of rotating a polishing table and the dummy disk; bringing the dummy disk into contact with a table surface of the polishing table while a liquid is supplied to the table surface; measuring heights of the table surface at a plurality of measurement points while the dummy disk is moved on the table surface; and creating a table profile showing tilt of the table surface from measurement values of the heights of the table surface. The dummy disk enables a surface height measurement instrument to accurately measure the heights of the table surface of the polishing table. The dummy disk is fixed to a disk holder of a dresser when heights of a table surface of a polishing table are measured. The dummy disk comprises a first surface capable of coming into contact with the disk holder; and a second surface which is on an opposite side of the first surface. The second surface has a plurality of liquid discharge channels, and the plurality of liquid discharge channels extends from one end of the second surface to the other end.

DESCRIPTION OF THE EMBODIMENTS

Embodiments of the disclosure are described below with reference to the drawings.

Figure 1:
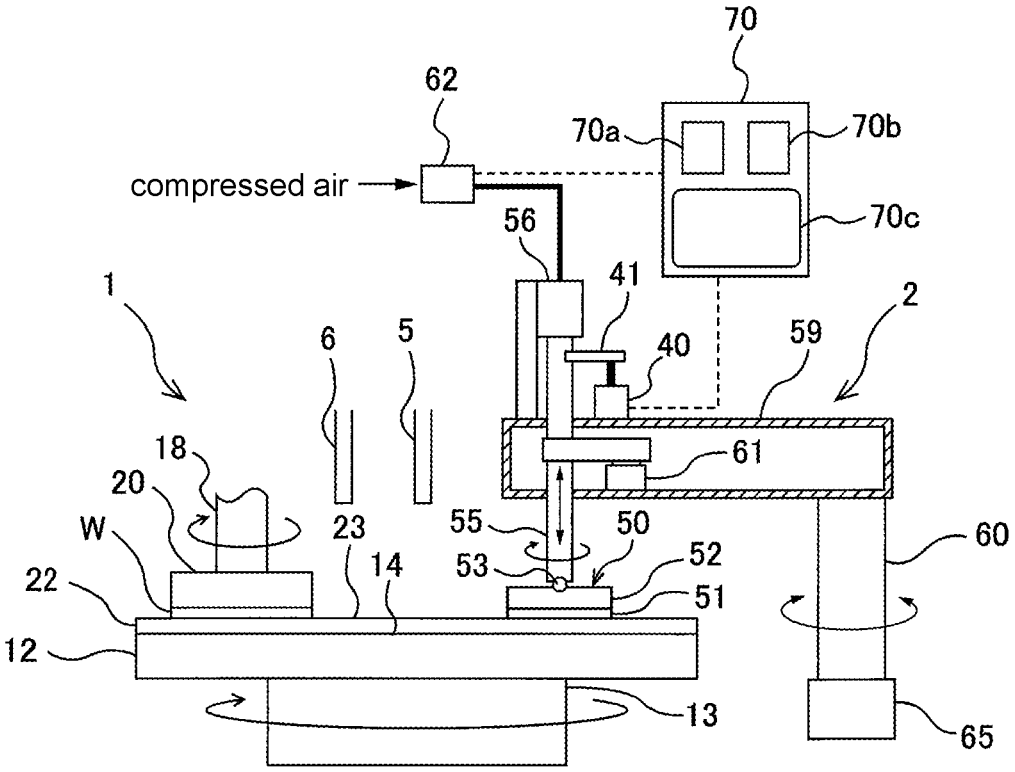
FIG. 1 is a schematic view showing one embodiment of a polishing device.

FIG. 1 is a schematic view showing one embodiment of a polishing device for polishing a wafer which is one example of a substrate. As shown in FIG. 1, the polishing device includes a polishing table 12 for holding a polishing pad 22, a liquid supply nozzle 5 for supplying a liquid (for example, pure water) onto the polishing pad 22, a slurry supply nozzle 6 for supplying slurry onto the polishing pad 22, a polishing unit 1 for polishing a wafer W, and a dressing unit 2 for dressing (conditioning) the polishing pad 22 which is used for polishing the wafer W.

The polishing unit 1 includes a polishing head 20 which is coupled to a low end of a polishing head shaft 18. The polishing head 20 is configured to hold the wafer W on a lower surface of the polishing head 20 by vacuum suction. The polishing head shaft 18 is rotated by drive of a motor not shown, and the polishing head 20 and the wafer W are rotated by the rotation of the polishing head shaft 18. The polishing head shaft 18 is moved up and down with respect to the polishing pad 22 by an up-down movement mechanism not shown (for example, configured by a servomotor, ball screws and the like).

The polishing table 12 is coupled to a table motor 13 arranged below the polishing table 12. The polishing table 12 is rotated around an axis thereof by the table motor 13. The polishing pad 22 is affixed onto a table surface 14 of the polishing table 12, and an upper surface of the polishing pad 22 configures a polishing surface 23 for polishing the wafer W.

The polishing of the wafer W is performed as below. The polishing head 20 and the polishing table 12 are respectively rotated, and the slurry is supplied from the slurry supply nozzle 6 onto the polishing pad 22. In this state, the polishing head 20 on which the wafer W is held is lowered, and the wafer W is pressed against the polishing surface 23 of the polishing pad 22. The wafer W and the polishing pad 22 are in sliding contact with each other in the presence of the slurry, and thereby a surface of the wafer W is polished.

The dressing unit 2 includes a dresser 50 in contact with the polishing surface 23 of the polishing pad 22, a dresser shaft 55 coupled to the dresser 50, an air cylinder 56 which is arranged on an upper end of the dresser shaft 55 and serves as a pressing force generation device, a dresser arm 59 which supports the dresser shaft 55 so that the dresser shaft 55 rotates freely, a spindle 60 which supports the dresser arm 59, and a swing motor 65 which is coupled to the spindle 60.

The dresser 50 includes a dressing disk 51 in which diamond particles are fix to a lower surface, a disk holder 52 which holds the dressing disk 51, and a gimbal mechanism 53 which can tilt the disk holder 52 and the dressing disk 51 with respect to the dresser shaft 55. The dressing disk 51 is detachably mounted to the disk holder 52 by a fastener (not shown) such as a screw or a magnet. The lower surface of the dressing disk 51 configures a dressing surface for dressing (conditioning) the polishing surface 23 of the polishing pad 22.

The gimbal mechanism 53 is a mechanism which enables the dresser 50 to be tilted according to a surface shape of the polishing surface 23 of the polishing pad 22. A specific configuration of the gimbal mechanism 53 is not particularly limited. For example, the gimbal mechanism 53 may be configured by a spherical bearing, a combination of a spherical bearing and an elastic member, or a combination of two spherical bearings which are disclosed in Japanese Patent Application Laid-Open No. 2010-172996 and No. 2016-144860.

The dresser shaft 55 and the dresser 50 can be moved up and down with respect to the dresser arm 59. The air cylinder 56 is a device which generates a force that the dresser 50 applies to the polishing pad 22. The air cylinder 56 is connected to a pressure regulator 62, and compressed air is supplied to the air cylinder 56 through the pressure regulator 62. The force with which the dresser 50 presses the polishing pad 22 is regulated by the pressure regulator 62.

The pressure regulator 62 is electrically connected to a data processing portion 70. Action of the pressure regulator 62 is controlled by the data processing portion 70. More specifically, the data processing portion 70 transmits a target value of a pressure of the compressed air to the pressure regulator 62, and the pressure regulator 62 acts to maintain the pressure of the compressed air within the air cylinder 56 at the target value.

The dresser shaft 55 is rotated by a dresser motor 61 installed inside the dresser arm 59, and the dresser 50 is rotated around an axis thereof by the rotation of the dresser shaft 55. The air cylinder 56 presses, via the dresser shaft 55, the dresser 50 to the polishing surface 23 of the polishing pad 22 with a predetermined force.

The data processing portion 70 is configured by at least one computer which includes a storage device 70*a* for storing a program, a processing device (CPU or the like) 70*b* for executing calculation according to the program, and a display screen 70*c* for displaying data, GUI (Graphical User Interface) and the like.

Figure 2:
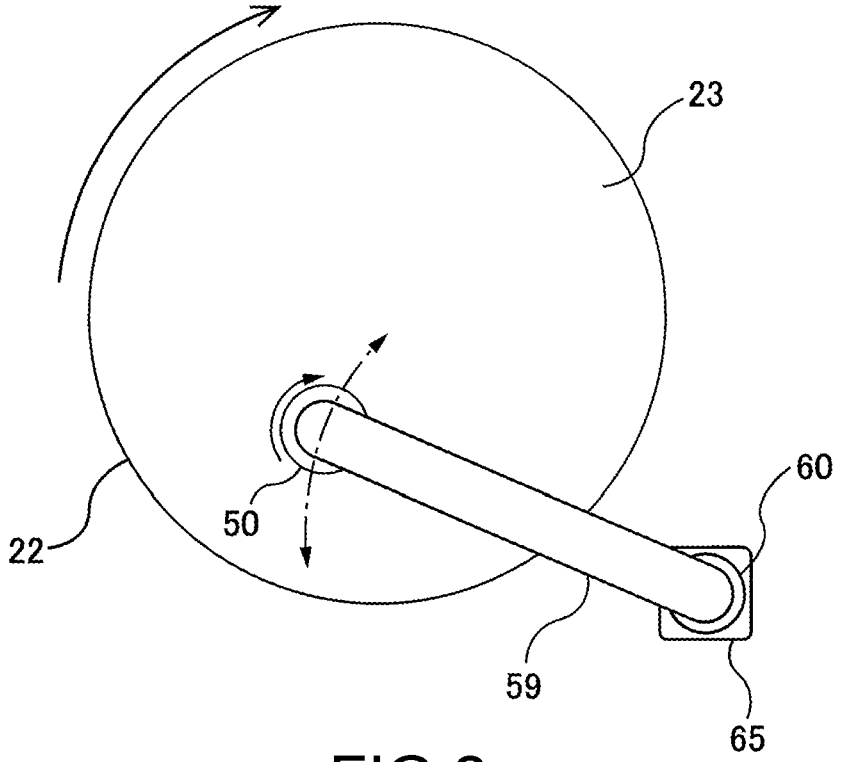
FIG. 2 is a top view of a dresser arm and a dresser.

FIG. 2 is a top view of the dresser arm 59 and the dresser 50. As shown in FIG. 2, the dresser arm 59 is driven by the swing motor 65 and swings around the spindle 60. Along with the swinging of the dresser arm 59, the dresser 50 which is coupled to one end of the dresser arm 59 is moved in a radial direction of the polishing pad 22 on the polishing surface 23 of the polishing pad 22.

The dressing of the polishing surface 23 of the polishing pad 22 is performed as below. The polishing table 12 and the polishing pad 22 are rotated by the table motor 13, and the liquid (for example, pure water) is supplied from the liquid supply nozzle 5 to the polishing surface 23 of the polishing pad 22. Furthermore, the dresser 50 is rotated around the axis thereof. The dresser 50 is pressed to the polishing surface 23 by the air cylinder 56, and the lower surface (the dressing surface) of the dressing disk 51 is in sliding contact with the polishing surface 23. In this state, the dresser arm 59 is swung, and the dresser 50 on the polishing pad 22 is moved in a substantially radial direction of the polishing pad 22. The polishing pad 22 is scraped off by the rotating dresser 50, and thereby the dressing of the polishing surface 23 is performed.

A movement direction of the dresser 50 is not completely parallel to the table surface 14, and an angle between the movement direction of the dresser 50 and the table surface 14 is within a minute range which does not affect the dressing action.

A pad height sensor 40 which measures heights of the polishing surface 23 is fixed to the dresser arm 59. In addition, a sensor target 41 is fixed to the dresser shaft 55 and faces the pad height sensor 40. The sensor target 41 is moved up and down integrally with the dresser shaft 55 and the dresser 50. On the other hand, a position of the pad height sensor 40 in an up-down direction is fixed.

The pad height sensor 40 used in the embodiment is a displacement sensor, and the heights of the polishing surface 23 can be indirectly measured by measuring displacement of the sensor target 41. The sensor target 41 is coupled to the dresser 50 via the dresser shaft 55, and thus the pad height sensor 40 can measure the heights of the polishing surface 23 during the dressing of the polishing pad 22. Furthermore, as described later, the pad height sensor 40 can measure heights of the table surface 14 of the polishing table 12. In the embodiment, the pad height sensor 40 configures a surface height measurement instrument for measuring the heights of the polishing surface 23 and the heights of the table surface 14.

The pad height sensor 40 indirectly measures the heights of the polishing surface 23 from a position in the up-down direction of the dresser 50 which is in contact with the polishing surface 23. The heights of the polishing surface 23 are distances from a pre-set reference plane to the dressing disk 51. The reference plane is a virtual plane. In the embodiment, the reference plane is a swing plane of the dresser arm 59 or a plane parallel to the swing plane of the dresser arm 59. As the pad height sensor 40, any type of contact sensor or non-contact sensor such as a linear scale sensor, a laser sensor, an ultrasonic sensor, an eddy current sensor or the like can be used.

The pad height sensor 40 is connected to the data processing portion 70, and an output signal (that is, measurement values of the heights of the polishing surface 23) of the pad height sensor 40 is sent to the data processing portion 70. The data processing portion 70 creates a pad profile showing a distribution of the heights of the polishing surface 23 along the radial direction of the polishing table 12 from the measurement values of the heights of the polishing surface 23.

The polishing pad 22 is arranged on the polishing table 12. Therefore, the pad profile is affected by a table profile showing tilt of the table surface 14 of the polishing table 12. In order to accurately manage the pad profile, it is necessary to (i) create an accurate table profile before the polishing pad 22 is affixed to the table surface 14, and (ii) create an accurate pad profile after the polishing pad 22 is affixed to the table surface 14. The table profile represents the tilt of the table surface 14. More specifically, the table profile shows a relationship between the heights of the table surface 14 and the position of the polishing table 12 in the radial direction (hereinafter, referred to the table radial position).

One embodiment of a method for creating the table profile is described below. The table surface 14 is not completely parallel to the above-described reference plane due to mechanical errors in assembly. That is, a center axis line of the polishing table 12 is not completely perpendicular to the reference plane. The table profile reflects the tilt of the table surface 14 and is a profile unique to the polishing table 12.

The table profile is not affected by the polishing of the wafer or the dressing of the polishing pad 22 and is unchangeable. Therefore, the management of the pad profile is performed based on the table profile. Before the polishing pad 22 is arranged on the polishing table 12, the heights of the table surface 14 are measured, and the table profile is created from measurement values of the heights of the table surface 14.

Figure 3:
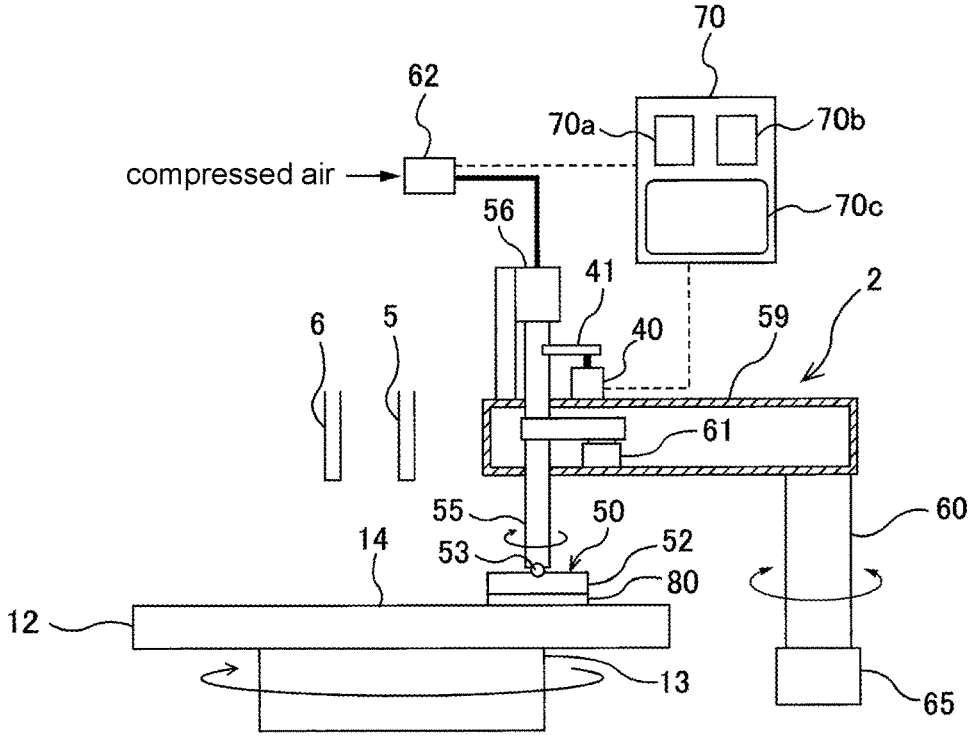
FIG. 3 is a diagram showing the polishing device when heights of a table surface are measured.

FIG. 3 is a diagram showing the polishing device when the heights of the table surface 14 are measured. The dressing disk 51 shown in FIG. 1 is removed from the disk holder 52, and a dummy disk 80 is mounted to the disk holder 52 instead. Similar to the dressing disk 51, the dummy disk 80 is detachably fixed to the disk holder 52 by a fastener (not shown) such as a screw or a magnet.

The dummy disk 80 is configured by a material softer than the table surface 14 so as not to scratch the table surface 14. In the embodiment, the table surface 14 is formed of SiC (silicon carbide), and the dummy disk 80 is formed of acrylic resin. However, the material of the dummy disk 80 is not limited to the acrylic resin, and other materials may be used as long as the material is softer than the table surface 14 and does not scratch the table surface 14.

The polishing table 12 is rotated in a state that the polishing pad is not affixed, and the liquid is further supplied onto the table surface 14 from the liquid supply nozzle 5. Pure water is used as the liquid. The liquid spreads on the table surface 14 due to a centrifugal force and forms a liquid film on the table surface 14. While the dresser motor 61 rotates the dresser shaft 55 and the dresser 50 (including the dummy disk 80), the air cylinder 56 lowers the dresser 50 and brings the rotating dummy disk 80 into contact with the table surface 14. Furthermore, while the swing motor 65 moves the dresser 50 (including the dummy disk 80) in the radial direction of the table surface 14, the pad height sensor 40 measures the heights of the table surface 14 for one or plural times at a plurality of measurement points.

The heights of the table surface 14 are distances from the above-described reference plane to the dummy disk 80. The measurement values of the heights of the table surface 14 are sent to the data processing portion 70. The data processing portion 70 creates a table profile from the measurement values of the heights of the table surface 14. When the heights of the table surface 14 are measured for plural times at a plurality of measurement points, an average of the measurement values obtained at the measurement points positioned at the same table radial position is calculated to create the table profile. The obtained table profile is stored in the storage device 70*a*.

In addition to avoid scratching of the table surface 14, the reason of using the dummy disk 80 for the measurement of the table surface 14 is that the posture of the dresser 50 is prevented becoming unstable due to the liquid on the table surface 14. That is, the dresser 50 includes the gimbal mechanism 53 which allows the dresser 50 to tilt freely with respect to the dresser shaft 55. When the dresser 50 is moved on the table surface 14, the liquid which is present between the dresser 50 and the table surface 14 easily makes the posture of the dresser 50 unstable. As a result, the dresser shaft 55 shakes up and down, and the measurement values of the table surface 14 are varied.

Figure 4:
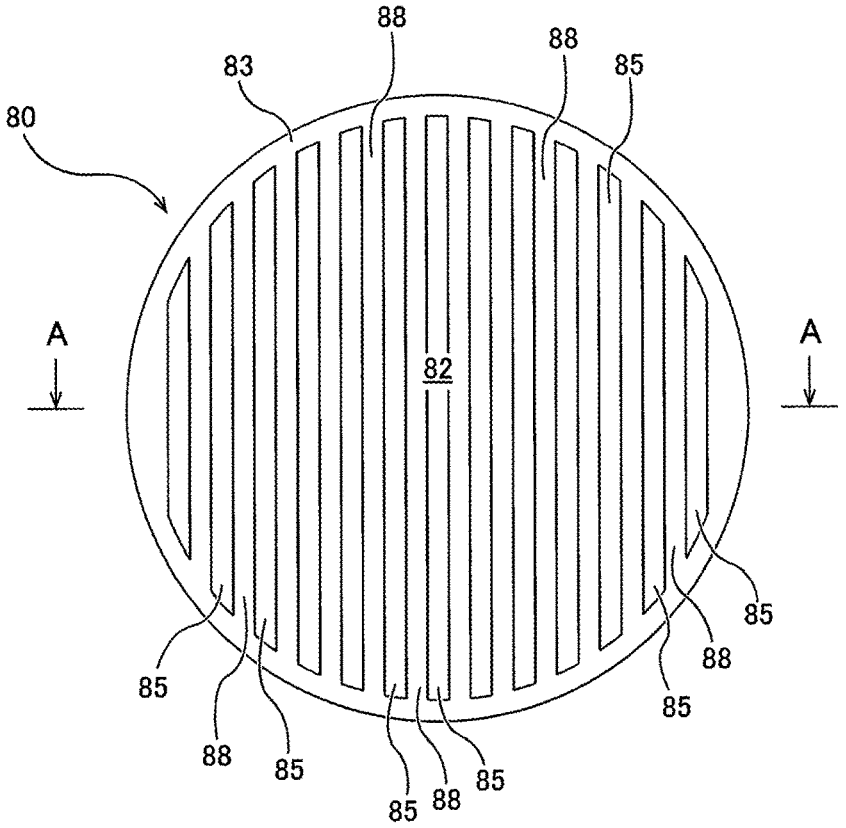
FIG. 4 is a bottom view showing one embodiment of a dummy disk.
Figure 5:
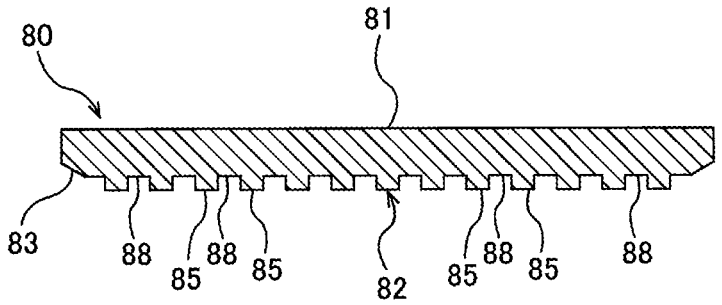
FIG. 5 is a cross-section view along an A-A line shown in FIG. 4.

Therefore, in order to eliminate the effect of the liquid, the dummy disk 80 includes a configuration described below. FIG. 4 is a bottom view showing one embodiment of the dummy disk 80, and FIG. 5 is a cross-section view along an A-A line shown in FIG. 4. The dummy disk 80 is circular. The dummy disk 80 includes a first surface 81 capable of coming into contact with the disk holder 52, and a second surface 82 which is on an opposite side of the first surface 81. The first surface 81 and the second surface 82 are flat surfaces. An annular tapered surface 83 is present surrounding the second surface 82.

When the dummy disk 80 is fixed to the disk holder 52, the first surface 81 comes into contact with the disk holder 52. When the heights of the table surface 14 are measured using the dummy disk 80, the second surface 82 faces the table surface 14. In the embodiment, both the first surface 81 and the second surface 82 are flat and circular. In one embodiment, one or both of the first surface 81 and the second surface 82 may have a flat annular shape.

The second surface 82 includes a plurality of protrusion portions 85 and a plurality of grooves 88 serving as a plurality of liquid discharge channels positioned between the plurality of protrusion portions 85. The plurality of grooves 88 extend from one end of the second surface 82 to the other end. That is, the plurality of grooves 88 extend across the entire second surface 82. In the embodiment, the plurality of grooves 88 are arranged according to a so-called line and space pattern. The plurality of grooves 88 are straight grooves arranged in parallel to each other. The grooves 88 are arranged at equal intervals and are uniformly distributed on the entire second surface 82.

The grooves 88 arranged as described above function as the liquid discharge channels. That is, when the liquid is supplied from the liquid supply nozzle 5 onto the table surface 14, the dummy disk 80 is rotated around an axis thereof and is moved on the table surface 14. The liquid which is present under the dummy disk 80 flows to the outside of the dummy disk 80 through the grooves 88, and all the plurality of protrusion portions 85 come into contact with the table surface 14. Because the grooves 88 extend from one end of the second surface 82 to the other end, the liquid does not stay under the dummy disk 80. As a result, all the protrusion portions 85 of the dummy disk 80 come into contact with the table surface 14, and the posture of the dummy disk 80, that is, the posture of the entire dresser 50 is stabilized.

In order to quickly guide the liquid present under the dummy disk 80 into the grooves 88, the grooves 88 are uniformly distributed over the entire second surface 82. An area of all the grooves 88 occupies about 50% of an area of the entire second surface 82.

Figure 6:
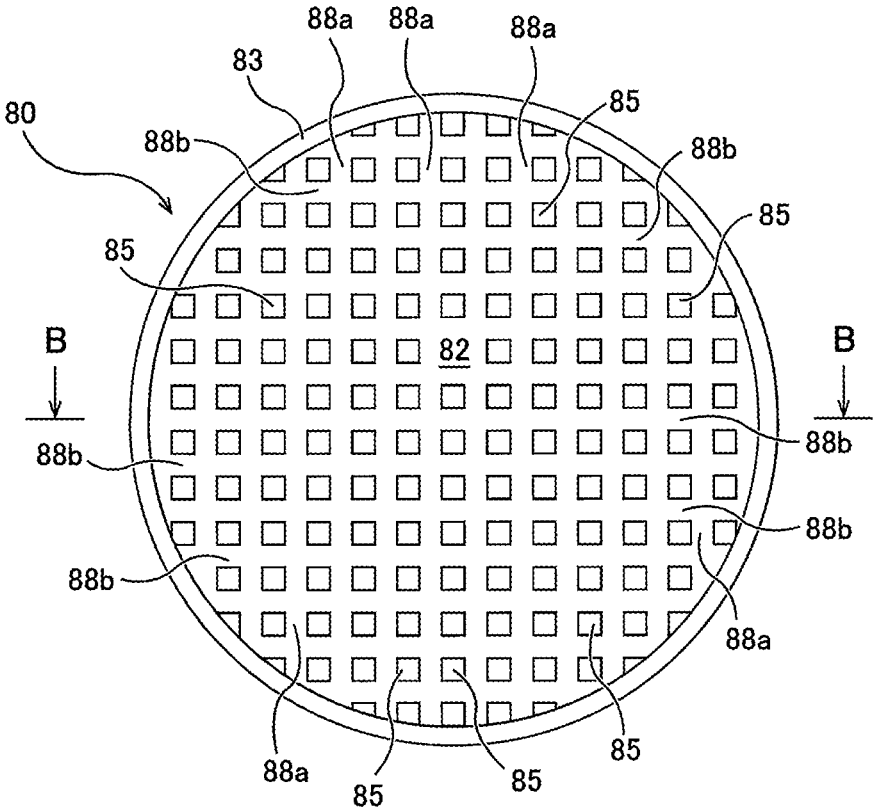
FIG. 6 is a bottom view showing one embodiment of a dummy disk.
Figure 7:
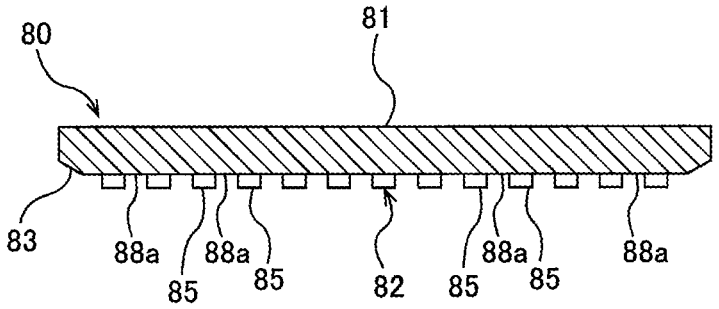
FIG. 7 is a cross-section view along a B-B line shown in FIG. 6.

FIG. 6 is a bottom view showing one embodiment of the dummy disk 80, and FIG. 7 is a cross-section view along a B-B line shown in FIG. 6. Details of the embodiment which are not particularly described are the same as the configurations shown in FIG. 4 and FIG. 5, and thus repeated description thereof is omitted.

As shown in FIG. 6, the dummy disk 80 of the embodiment has a plurality of first grooves 88*a* and a plurality of second grooves 88*b* as a plurality of liquid discharge channels. The plurality of second grooves 88*b* intersect the plurality of first grooves 88*a*. In the embodiment, the plurality of second grooves 88*b* are perpendicular to the plurality of first grooves 88*a*. The first grooves 88*a* extend from one end of the second surface 82 to the other end, and the second grooves 88*b* also extend from one end of the second surface 82 to the other end.

In order to quickly guide the liquid present under the dummy disk 80 into the grooves 88, the grooves 88 are uniformly distributed over the entire second surface 82. The area of all the grooves 88 occupies about 75% of the area of the entire second surface 82.

Figure 8:
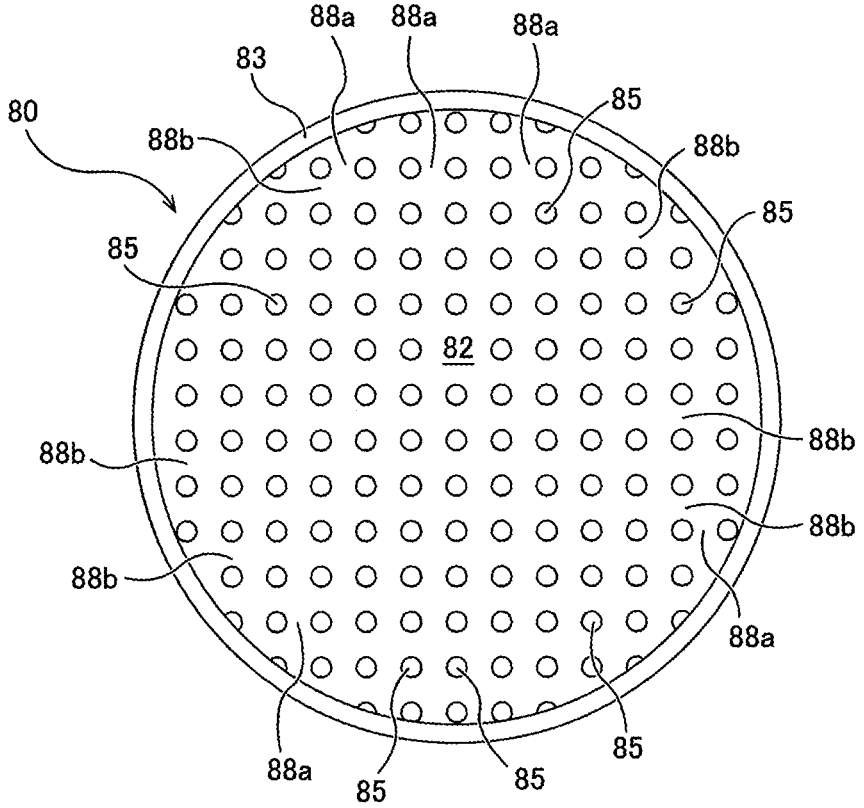
FIG. 8 is a bottom view showing one embodiment of a dummy disk.

The protrusion portions 85 shown in FIG. 6 are quadrilateral. As shown in FIG. 8, the protrusion portions 85 may also be circular. The dummy disk 80 shown in FIGS. 4-8 can solve instability of the posture of the dresser 50 which is caused by the liquid present between the dresser 50 and the table surface 14. However, as long as a plurality of liquid discharge channels extend from one end of the second surface 82 to the other end, the arrangement of the liquid discharge channels is not limited to these embodiments. In the one embodiment, the area of all the grooves 88 (or the grooves 88*a* and 88*b*) occupies 40%-81% of the area of the entire second surface 82.

Figure 9:
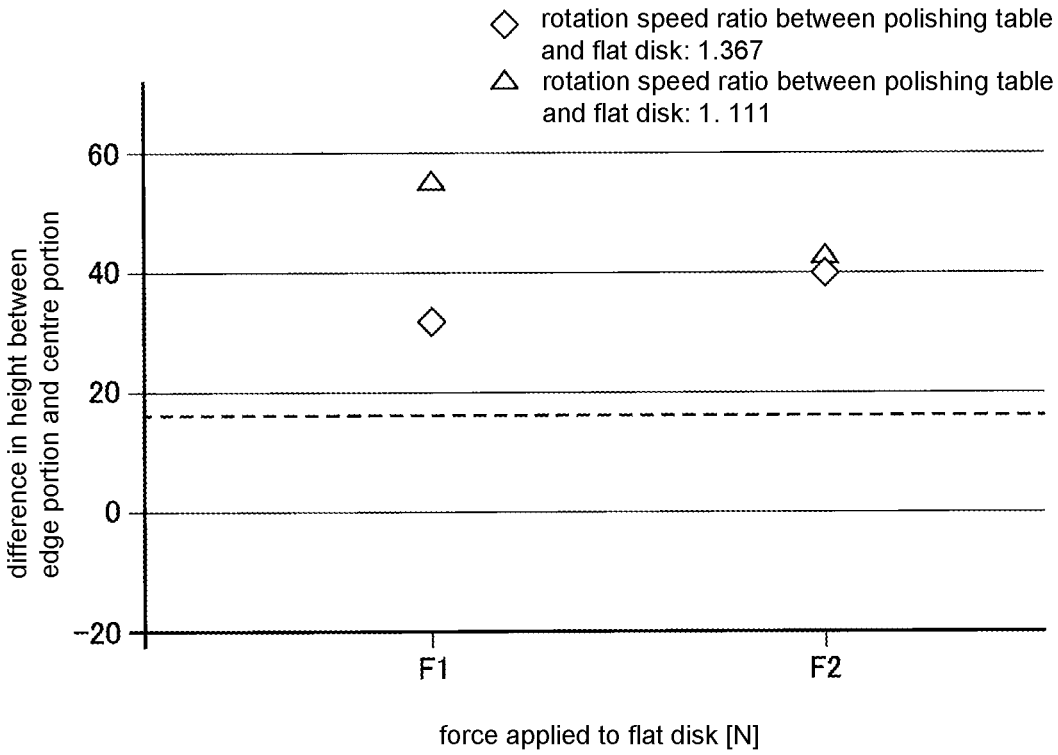
FIG. 9 is a graph showing a result obtained by measuring heights of a table surface using a flat disk for test which has no liquid discharge channel.

FIG. 9 is a graph showing a result obtained by measuring the heights of the table surface 14 using a flat disk for test which has no liquid discharge channel. In FIG. 9, a vertical axis represents a difference in height between an edge portion and a center portion of the table surface 14, and a horizontal axis represents the force [N] for pressing the flat disk against the table surface 14. A relationship between forces F1 and F2 on the horizontal axis in FIG. 9 is F1<F2. A horizontal dotted line in the graph represents the difference in height between the edge portion and the center portion of the table surface 14, the difference being measured under static conditions that the polishing table 12 and the flat disk are not rotated and no liquid is supplied onto the table surface 14.

The heights of the table surface 14 are dynamically measured while the polishing table 12 and the flat disk are rotated and the liquid is supplied onto the table surface 14. Furthermore, while a combination of a rotation speed of the polishing table 12 and a rotation speed of the flat disk is changed, and the force for pressing the flat disk against the table surface 14 is changed, the height of the edge portion of the table surface 14 and the height of the center portion of the table surface 14 are measured. As known from FIG. 9, if the force applied to the flat disk is changed, a measurement result is varied. Furthermore, the measurement result is greatly different from the result (shown by the horizontal dotted line) which is statically measured while the polishing table 12 and the flat disk are rotated.

Figure 10:
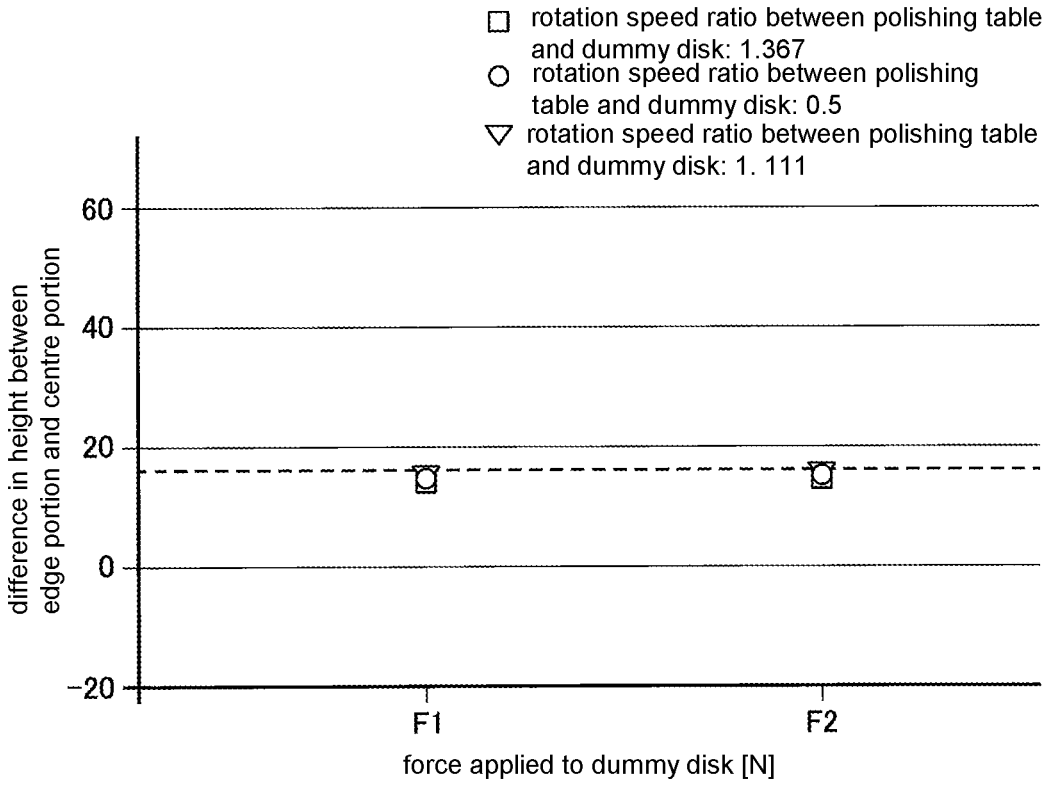
FIG. 10 is a graph showing a result obtained by measuring heights of a table surface using the dummy disk shown in FIG. 4.
Figure 11:
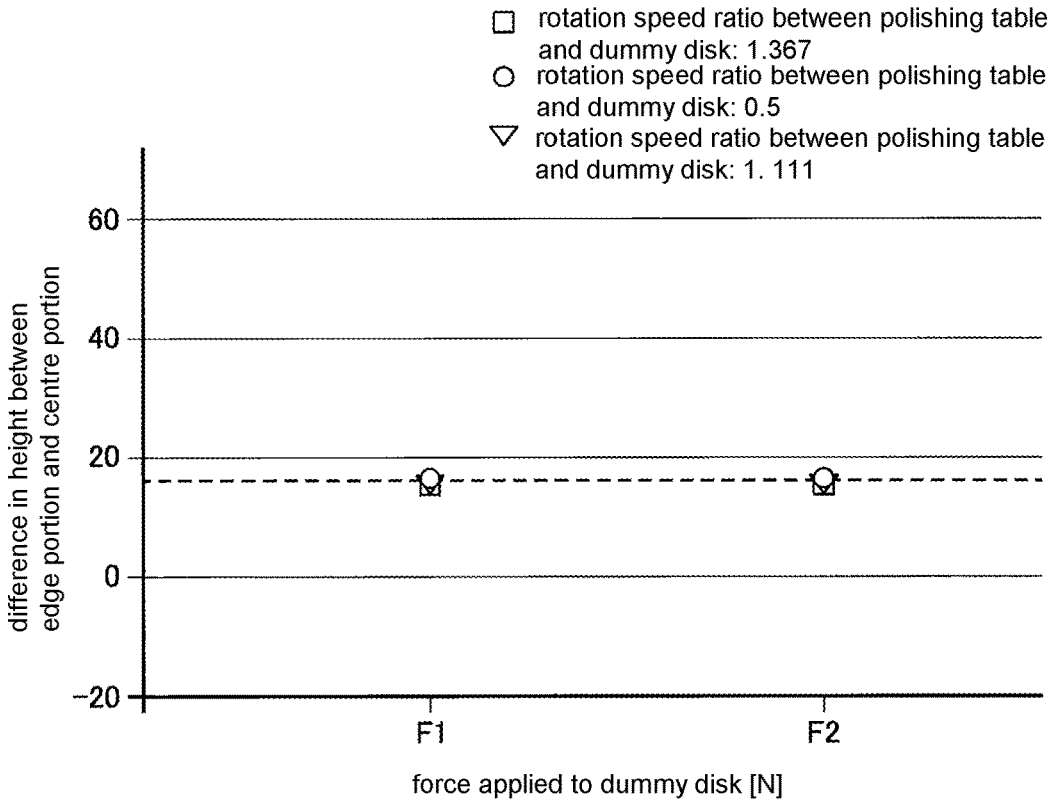
FIG. 11 is a graph showing a result obtained by measuring heights of a table surface using the dummy disk shown in FIG. 6.
Figure 12:
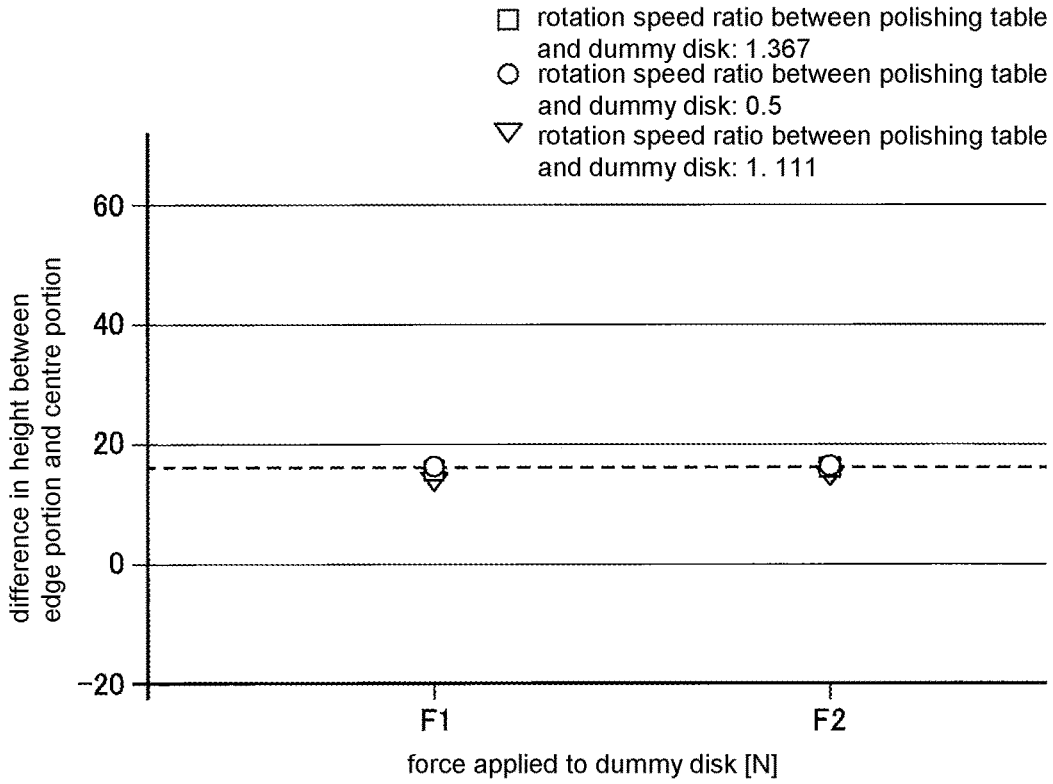
FIG. 12 is a graph showing a result obtained by measuring heights of a table surface using the dummy disk shown in FIG. 8.

FIG. 10 is a graph showing a result obtained by measuring the heights of the table surface 14 using the dummy disk 80 shown in FIG. 4, FIG. 11 is a graph showing a result obtained by measuring the heights of the table surface 14 using the dummy disk 80 shown in FIG. 6, and FIG. 12 is a graph showing a result obtained by measuring the heights of the table surface 14 using the dummy disk 80 shown in FIG. 8. In FIGS. 10-12, the vertical axis represents a difference in height between the edge portion and the center portion of the table surface 14, and the horizontal axis represents the force [N] for pressing the dummy disk 80 against the table surface 14. A horizontal dotted line in the graph represents the difference in height between the edge portion and the center portion of the table surface 14, the difference being measured under static conditions that the polishing table 12 and the dummy disk 80 are not rotated and no liquid is supplied onto the table surface 14.

The heights of the table surface 14 are dynamically measured while the polishing table 12 and the dummy disk 80 are rotated and the liquid is supplied onto the table surface 14. As known from the graphs shown in FIG. 10, FIG. 11, and FIG. 12, the measurement results are substantially constant regardless of changes in the force applied to the dummy disk 80, and variation in the measurement results is small. Furthermore, the measurement results are very close to the result (shown by the horizontal dotted line) which is statically measured while the polishing table 12 and the dummy disk 80 are not rotated.

The above test results show that compared with the flat disk having no liquid discharge channel, the dummy disk 80 which has the plurality of liquid discharge channels 88 (or 88*a*, 88*b*) are unlikely to be affected by the presence of the liquid on the table surface 14, and the posture of the dummy disk 80 is stable. As a result, the pad height sensor (the surface height measurement instrument) 40 can accurately measure the heights of the table surface 14, and the data processing portion 70 can create an accurate table profile.

After the table profile is created by the data processing portion 70, an unused (new) polishing pad 22 is affixed to the table surface 14. In order to create distribution of heights of a polishing surface 23 of the unused polishing pad 22, that is, a unique pad profile, the dressing disk 51 or the above-described dummy disk 80 is used. The unique pad profile shows a relationship between a table radial position and heights of the polishing surface 23 when initial dressing of the polishing pad 22 is performed, or heights of the polishing surface 23 before the initial dressing of the polishing pad 22 is performed. One embodiment of a creating method of the unique pad profile using the dressing disk 51 is described below.

The dummy disk 80 is removed from the disk holder 52, and the dressing disk 51 is fixed to the disk holder 52. The unused polishing pad 22 is rotated along with the polishing table 12 by the table motor 13, and the dresser 50 including the dressing disk 51 is rotated by the dresser motor 61. While a liquid is supplied from the liquid supply nozzle 5 to the polishing surface 23 of the polishing pad 22, the dressing disk 51 is brought into contact with the polishing surface 23. Pure water is used as the liquid. Furthermore, the swing motor 65 moves the dresser 50 (including the dressing disk 51) in a radial direction of the polishing pad 22. In this way, the dressing disk 51 performs the initial dressing of the polishing pad 22 while moving on the polishing surface 23.

While the dresser 50 (including the dressing disk 51) moves in the radial direction of the polishing pad 22, the pad height sensor 40 measures the heights of the polishing surface 23 of the polishing pad 22 at a plurality of measurement points. The heights of the polishing surface 23 are distances from the reference plane used in the measurement of the heights of the table surface 14 to the dressing disk 51. Measurement values of the heights of the polishing surface 23 are sent to the data processing portion 70. The data processing portion 70 creates the unique pad profile from the measurement values of the heights of the polishing surface 23. The data processing portion 70 stores the obtained unique pad profile in the storage device 70*a*.

Figure 13:
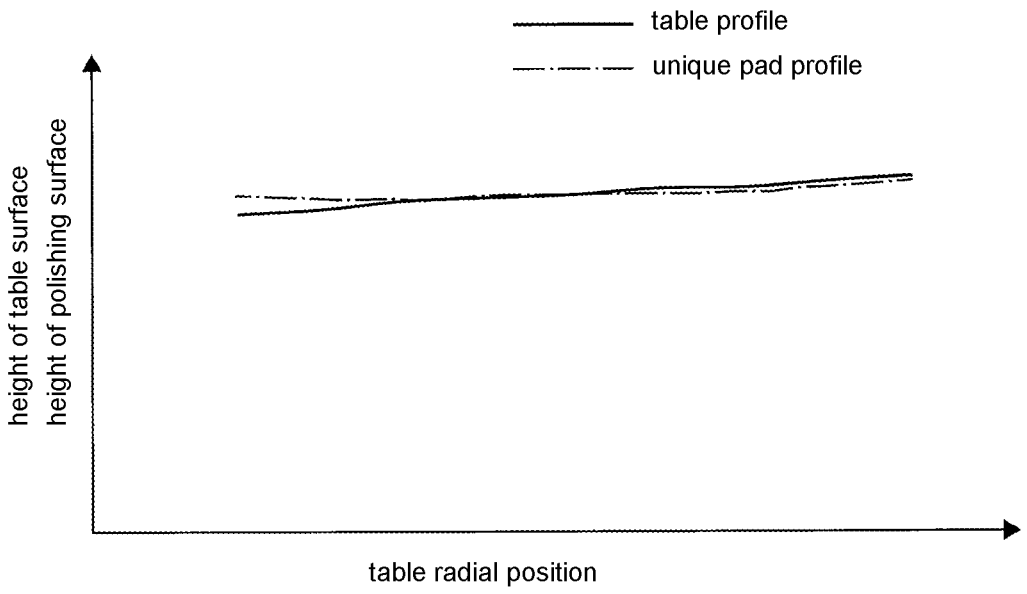
FIG. 13 is a diagram showing a table profile and a unique pad profile on a display screen.

The data processing portion 70 displays, as shown in FIG. 13, the table profile and the unique pad profile on the display screen 70*c* (see FIG. 1). In FIG. 13, the vertical axis represents the heights of the table surface 14 and the heights of the polishing surface 23 from the reference plane, and the horizontal axis represents the table radial position. It is ideal that the polishing surface 23 of the polishing pad 22 is parallel to the table surface 14. However, as shown in FIG. 13, the unique pad profile is usually not coincident with the table profile.

Therefore, the polishing surface 23 of the polishing pad 22 is scraped off using the dressing disk 51, and a pre-conditioning dressing to make the pad profile be coincident with the table profile is performed. Specifically, while the polishing table 12 and the dresser 50 (including the dressing disk 51) are respectively rotated, the liquid is supplied from the liquid supply nozzle 5 onto the polishing surface 23 of the polishing pad 22. While the rotating dressing disk 51 is pressed against the polishing surface 23, and while the liquid is supplied onto the polishing surface 23, the dresser 50 is moved in the radial direction of the polishing pad 22.

When the dresser 50 is moved on the polishing pad 22, a force with which the air cylinder 56 presses the dresser 50 against the polishing pad 22 is regulated by the pressure regulator 62. More specifically, when the rotating dressing disk 51 is moved on the polishing pad 22, the data processing portion 70 controls the action of the pressure regulator 62 shown in FIG. 1 to regulate, based on a difference between the table profile and the unique pad profile, the force with which the air cylinder 56 presses the dressing disk 51 against the polishing surface 23. For example, at a table radial position where the height of the polishing surface 23 on the unique pad profile is higher than the height of the table surface 14 on the table profile, the air cylinder 56 presses the dressing disk 51 against the polishing pad 22 with a greater force. On the other hand, at a table radial position where the height of the polishing surface 23 on the unique pad profile is lower than the height of the table surface 14 on the table profile, the air cylinder 56 presses the dressing disk 51 against the polishing pad 22 with a smaller force.

Thereby, the force with which the dressing disk 51 presses the polishing pad 22 is regulated based on the difference between the table profile and the unique pad profile, and the pad profile is made to be coincident with the table profile. The dressing is a pre-conditioning dressing of the polishing pad 22. In the following description, a pad profile (that is, a pre-conditioned pad profile) which is coincident with the table profile by dressing a polishing pad 22 which has not been used in the polishing of the wafer is called an initial pad profile. The initial pad profile shows a relationship between the heights of the polishing surface 23 of the polishing pad 22 to which the pre-conditioning dressing is performed and the table radial position.

Figure 14:
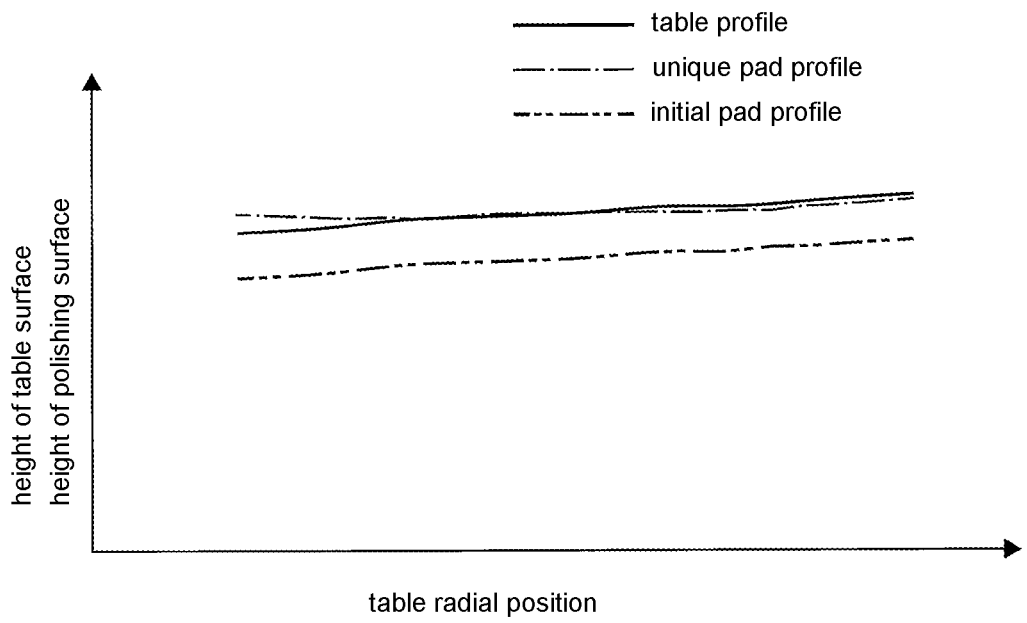
FIG. 14 is a graph showing the table profile, the unique pad profile, and an initial pad profile.

FIG. 14 is a graph showing the table profile, the unique pad profile, and the initial pad profile. In FIG. 14, the vertical axis represents the heights of the table surface 14 and the heights of the polishing surface 23 from the reference plane, and the horizontal axis represents a table radial position (the position of the polishing table 12 in the radial direction). As known from FIG. 14, the initial pad profile is coincident with the table profile.

The initial pad profile is the pad profile of the polishing pad 22 which has not been used in the polishing of the wafer. Each time the wafer is polished, the polishing surface 23 of the polishing pad 22 is dressed by the dresser 50. At this time, in order that the pad profile is coincident with the table profile, the data processing portion 70 issues a command to the pressure regulator 62 to regulate the force with which the air cylinder 56 presses the dresser 50 against the polishing pad 22. Thereby, the pad profile after the wafer polishing is maintained based on the table profile.

A rotation axis of the polishing table 12 slightly tilts with respect to a vertical direction, that is, the axis of the spindle 60 which is a swinging shaft of the dresser 50, due to mechanical errors at the time of assembling. Thus, the table surface 14 slightly tilts with respect to the horizontal direction. As shown in FIG. 14, the entire table profile also tilts. Therefore, the data processing portion 70 calculates a tilt angle of the table profile and correct the tilt of the table profile. The tilt angle of the table profile is a tilt angle of the entire table profile from a horizontal line. The horizontal line is a virtual line indicating the horizontal direction. The data processing portion 70 stores the obtained tilt angle of the table profile in the storage device 70*a*.

The data processing portion 70 corrects the table profile by rotating the table profile until the tilt angle is 0. The data processing portion 70 corrects the unique pad profile and the initial pad profile by respectively rotating the unique pad profile and the initial pad profile with the same angle as the tilt angle of the table profile. A direction in which the unique pad profile and the initial pad profile are rotated is the same as the direction in which the table profile is rotated. The data processing portion 70 displays the corrected table profile, the corrected unique pad profile, and the corrected initial pad profile on the display screen 70*c*.

Figure 15:
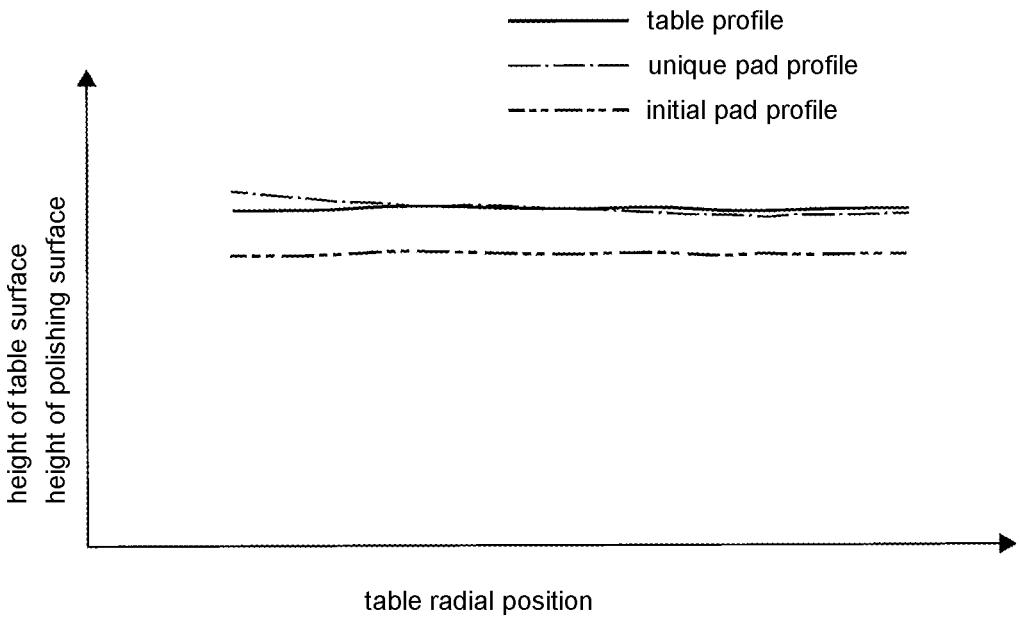
FIG. 15 is a diagram showing a corrected table profile, a corrected unique pad profile, and a corrected initial pad profile which are displayed on a display screen.

FIG. 15 is a diagram showing the corrected table profile, the corrected unique pad profile, and the corrected initial pad profile which are displayed on the display screen 70*c*. As shown in FIG. 15, the corrected table profile and the corrected initial pad profile are horizontally displayed on the display screen 70*c*.

The unique pad profile is created before the pre-conditioning dressing of the polishing pad 22 is performed. On the other hand, the initial pad profile is created when the pre-conditioning dressing is performed and before the wafer is polished. After the initial pad profile is created, the wafer is polished on the polishing surface 23 of the polishing pad 22, and then the polishing pad 22 is dressed. Each time the polishing pad 22 is dressed, the heights of the polishing surface 23 are measured by the pad height sensor 40, and the pad profile is created by the data processing portion 70 from the measurement values of the heights of the polishing surface 23.

When the polishing surface 23 of the polishing pad 22 is dressed, the liquid is supplied to the polishing surface 23. The posture of the dresser 50 including the gimbal mechanism 53 is easily affected by the liquid present between the dresser 50 and the polishing pad 22. As a result, the measurement values of the heights of the polishing surface 23 of the polishing pad 22 which are indirectly measured using the dresser 50 change easily. Therefore, in order to stabilize the posture of the dresser 50 and measure accurate heights of the polishing surface 23, similar to the above-described dummy disk 80, the dressing disk 51 includes a plurality of liquid discharge channels described later.

Figure 16:
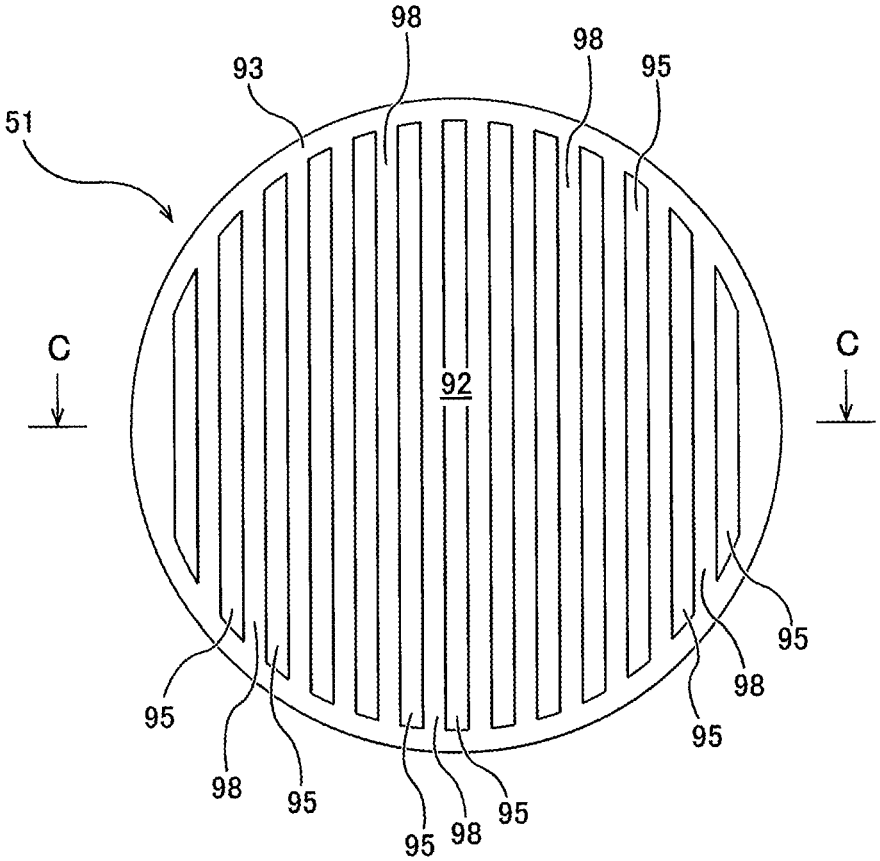
FIG. 16 is a bottom view showing one embodiment of a dressing disk.
Figure 17:
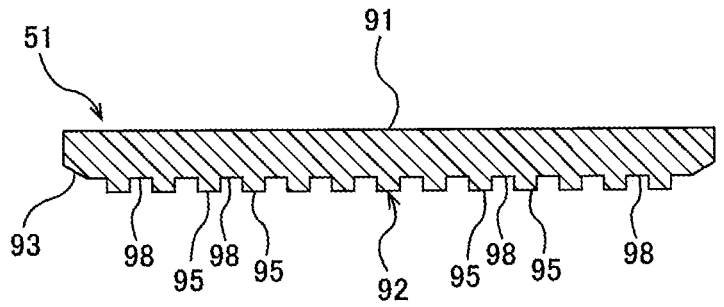
FIG. 17 is a cross-section view along a C-C line shown in FIG. 16.

FIG. 16 is a bottom view showing one embodiment of the dressing disk 51, and FIG. 17 is a cross-section view along a C-C line shown in FIG. 16. The dressing disk 51 is circular. The dressing disk 51 includes a first surface 91 capable of coming into contact with the disk holder 52, and a second surface 92 which is on an opposite side of the first surface 91. The first surface 91 and the second surface 92 are flat surfaces. An annular tapered surface 93 is present surrounding the second surface 92.

When the dressing disk 51 is fixed to the disk holder 52, the first surface 91 comes into contact with the disk holder 52. When the heights of the polishing surface 23 of the polishing pad 22 are measured using the dressing disk 51, the second surface 92 faces the polishing surface 23. In the embodiment, both the first surface 91 and the second surface 92 are flat and circular. In one embodiment, one or both of the first surface 91 and the second surface 92 may have a flat annular shape.

The second surface 92 includes a plurality of protrusion portions 95 and a plurality of grooves 98 serving as a plurality of liquid discharge channels positioned between the plurality of protrusion portions 95. Diamond particles which are abrasive grains for shaping (dressing) the polishing surface 23 of the polishing pad 22 are fixed onto surfaces of the plurality of protrusion portions 95. The diamond particles are fine particles, and thus the diamond particles are not depicted in FIG. 16.

The plurality of grooves 98 extend from one end of the second surface 92 to the other end. That is, the plurality of grooves 98 extend across the entire second surface 92. In the embodiment, the plurality of grooves 98 are arranged according to a so-called line and space pattern. The plurality of grooves 98 are straight grooves arranged in parallel to each other. The grooves 98 are arranged at equal intervals and are uniformly distributed on the entire second surface 92.

The grooves 98 which are arranged as described above function as the liquid discharge channels. That is, when the liquid is supplied from the liquid supply nozzle 5 to the polishing surface 23 of the polishing pad 22, the dressing disk 51 is rotated around an axis thereof and is moved on the polishing surface 23 of the polishing pad 22. The liquid which is present under the dressing disk 51 flows to the outside of the dressing disk 51 through the grooves 98, and all the plurality of protrusion portions 95 come into contact with the polishing surface 23. Because the grooves 98 extend from one end of the second surface 92 to the other end, the liquid does not stay under the dressing disk 51. As a result, all the protrusion portions 95 of the dressing disk 51 come into contact with the polishing surface 23 of the polishing pad 22, and a posture of the dressing disk 51, that is, the posture of the entire dresser 50 is stabilized.

In order to quickly guide the liquid present under the dressing disk 51 into the grooves 98, the grooves 98 are uniformly distributed over the entire second surface 92. An area of the entire grooves 98 occupies about 50% of an area of the entire second surface 92.

Figure 18:
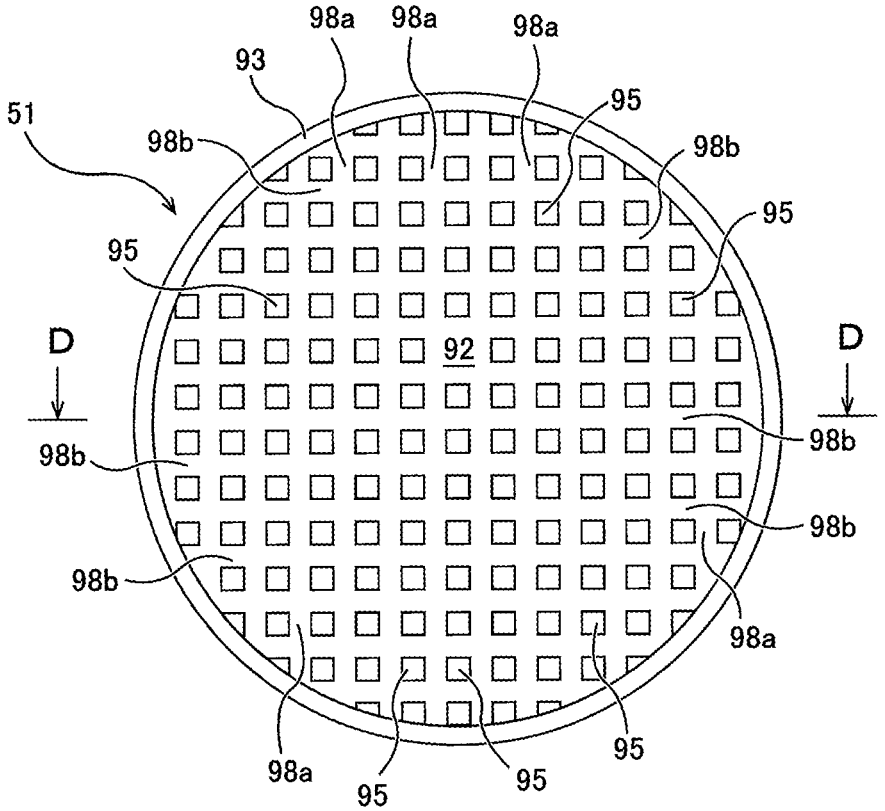
FIG. 18 is a bottom view showing one embodiment of a dressing disk.
Figure 19:
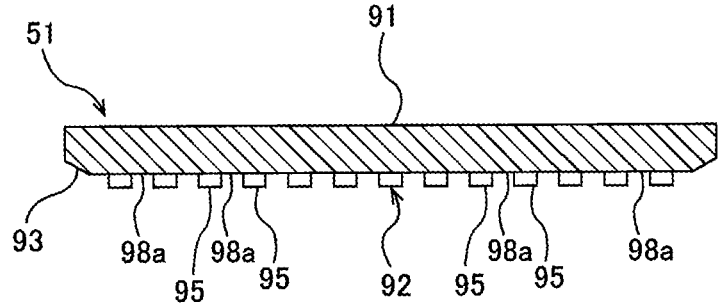
FIG. 19 is a cross-section view along a D-D line shown in FIG. 18.

FIG. 18 is a bottom view showing one embodiment of the dressing disk 51, and FIG. 19 is a cross-section view along a D-D line shown in FIG. 18. Details of the embodiment which are not particularly described are the same as the configurations shown in FIG. 16 and FIG. 17, and thus repeated description thereof is omitted.

As shown in FIG. 18, the dressing disk 51 of the embodiment has a plurality of first grooves 98*a* and a plurality of second grooves 98*b* as a plurality of liquid discharge channels. The plurality of second grooves 98*b* intersect the plurality of first grooves 98*a*. In the embodiment, the plurality of second grooves 98*b* are perpendicular to the plurality of first grooves 98*a*. The first grooves 98*a* extend from one end of the second surface 92 to the other end, and the second grooves 98*b* also extend from one end of the second surface 92 to the other end.

In order to quickly guide the liquid present under the dressing disk 51 into the grooves 98, the grooves 98 are uniformly distributed over the entire second surface 92. The area of the entire grooves 98 occupies about 75% of the area of the entire the second surface 92.

Figure 20:
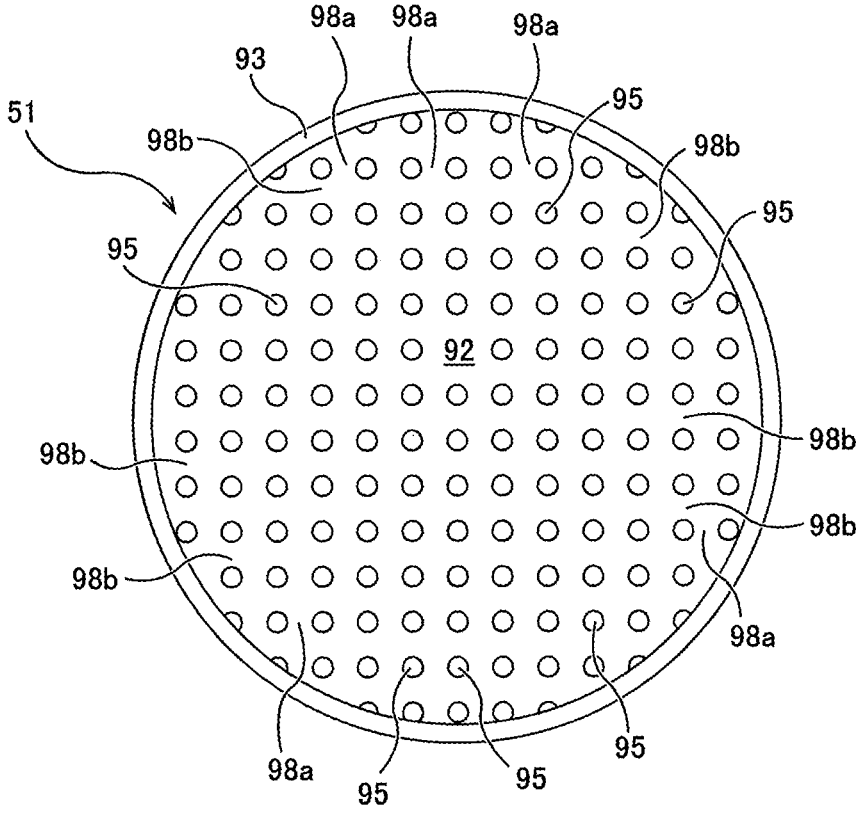
FIG. 20 is a bottom view showing one embodiment of a dressing disk.

The protrusion portions 95 shown in FIG. 18 are quadrilateral. As shown in FIG. 20, the protrusion portions 95 may also be circular. The dressing disk 51 shown in FIGS. 16-20 can solve instability of the posture of the dresser 50 which is caused by the liquid present between the dresser 50 and the polishing surface 23 of the polishing pad 22. However, as long as the plurality of liquid discharge channels extend from one end of the second surface 92 to the other end, the arrangement of the liquid discharge channels is not limited to these embodiments. In one embodiment, the area of all the grooves 98 (or the grooves 98*a*, 98*b*) occupies 40%-81% of the area of the entire second surface 92.

The same as the dummy disk 80 shown in FIGS. 4-8, the dressing disk 51 which has the plurality of liquid discharge channels 98 (or 98*a*, 98*b*) are unlikely to be affected by the presence of the liquid on the polishing pad 22, and the posture of the dressing disk 51 is stable. As a result, the pad height sensor (the surface height measurement instrument) 40 can accurately measure the heights of the polishing surface 23, and the data processing portion 70 can create an accurate pad profile. The above-described unique pad profile and the initial pad profile are also created from the measurement values of the heights of the polishing surface 23 which are obtained using the dressing disk 51 according to any one of the embodiments shown in FIGS. 16-20.

Figure 21:
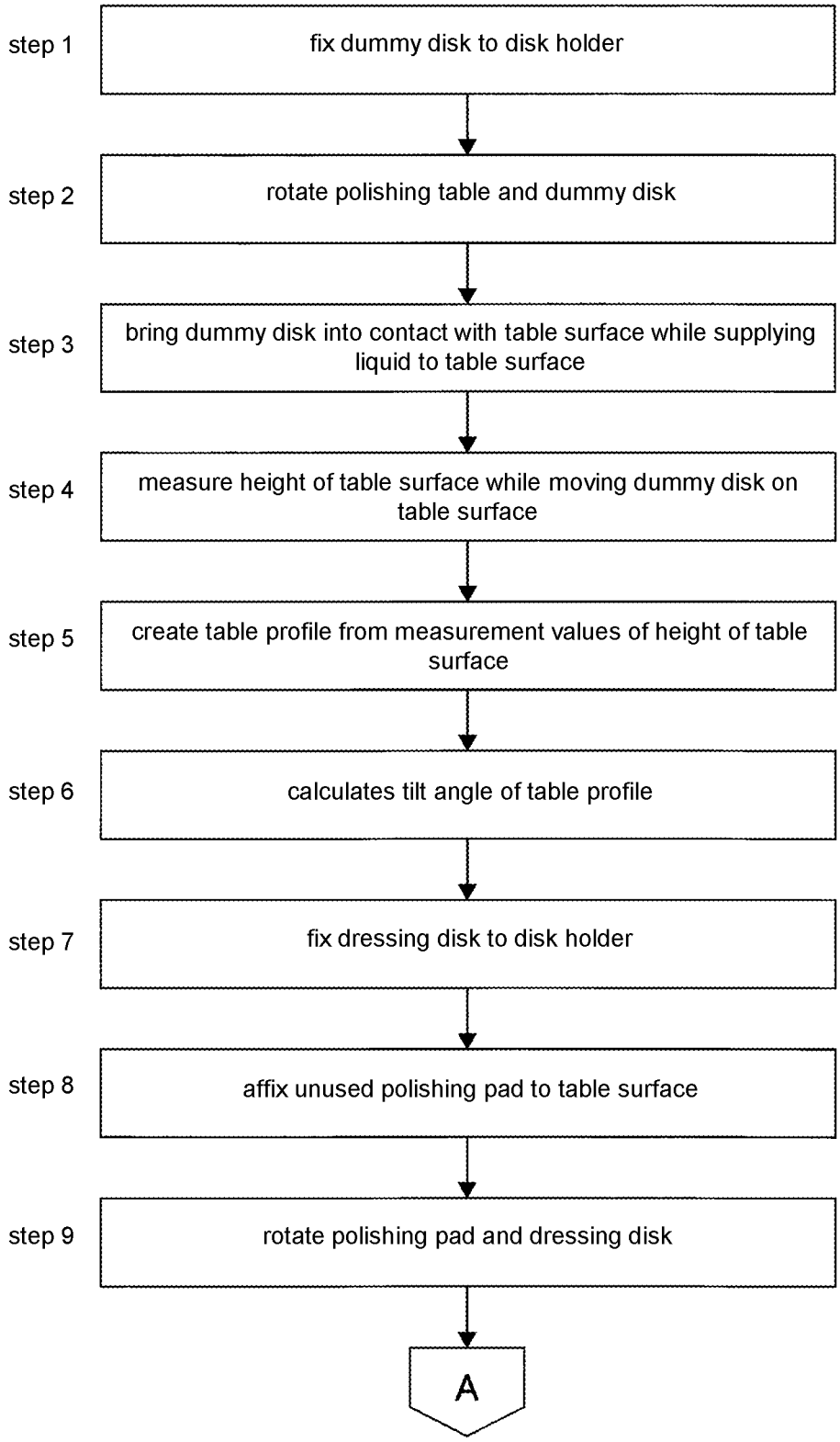
FIG. 21 is a diagram showing a part of a flowchart that shows one embodiment of creation of a table profile which uses the above-described dummy disk and creation of a pad profile which uses the above-described dressing disk.
Figure 22:
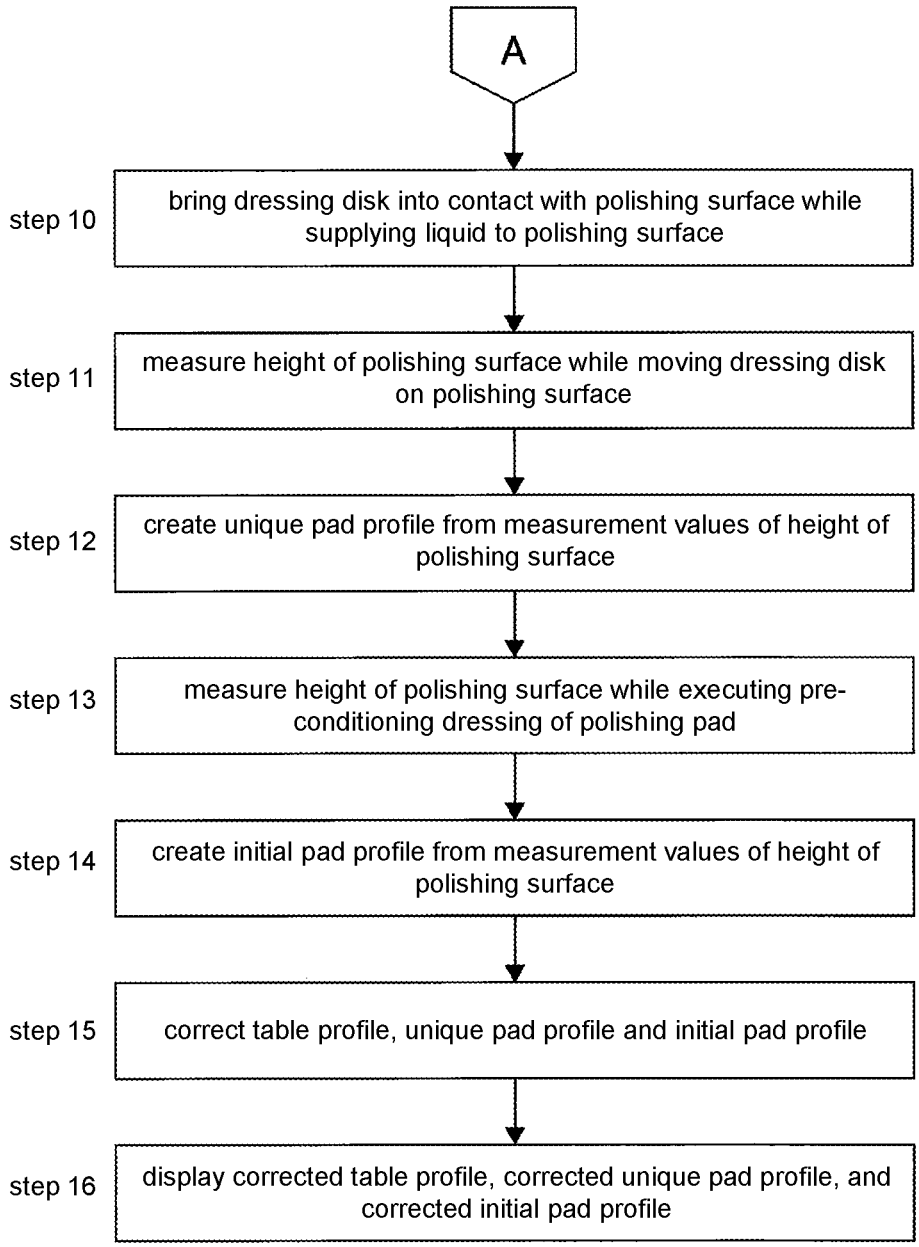
FIG. 22 is a view showing the rest part of the flowchart.

Next, one embodiment of the creation of the table profile using the above-described dummy disk 80 and the creation of the pad profile using the above-described dressing disk 51 is described using flowcharts shown in FIG. 21 and FIG. 22. The dummy disk 80 described below is the dummy disk according to any one of the embodiments shown in FIGS. 4-8, and the dressing disk 51 described below is the dressing disk according to any one of the embodiments shown in FIGS. 16-20.

In step 1, as shown in FIG. 3, the dummy disk 80 is fixed to the disk holder 52 of the dresser 50.

In step 2, the table motor 13 rotates the polishing table 12 in a state that the polishing pad is not affixed; furthermore, the dresser motor 61 rotates the dummy disk 80 along with the disk holder 52.

In step 3, while a liquid is supplied from the liquid supply nozzle 5 to the table surface 14 of the polishing table 12, the air cylinder 56 lowers the dresser 50 and brings the rotating dummy disk 80 into contact with the table surface 14. Pure water is used as the liquid. The liquid spreads on the table surface 14 due to the centrifugal force and forms a liquid film on the table surface 14.

In step 4, while the swing motor 65 moves the dresser 50 (including the dummy disk 80) on the table surface 14 in the radial direction of the polishing table 12, the pad height sensor (the surface height measurement instrument) 40 measures the heights of the table surface 14 at a plurality of measurement points. The heights of the table surface 14 are the distances from the reference plane to the dummy disk 80. The measurement values of the heights of the table surface 14 are sent to the data processing portion 70. After the heights of the table surface 14 are measured, the liquid is stopped from being supplied to the table surface 14, and the rotation of the polishing table 12 and the dresser 50 (including the dummy disk 80) is stopped.

In step 5, the data processing portion 70 creates the table profile from the measurement values of the heights of the table surface 14.

In step 6, the data processing portion 70 calculates the tilt angle of the table profile. The tilt angle of the table profile is the tilt angle of the entire table profile from the horizontal line. The data processing portion 70 stores the obtained table profile and the tilt angle in the storage device 70*a*.

In step 7, the dummy disk 80 is removed from the disk holder 52, and the dressing disk 51 is fixed to the disk holder 52.

In step 8, an unused polishing pad 22 is affixed to the table surface 14 of the polishing table 12. Step 8 may also be executed before step 7.

In step 9, the table motor 13 rotates the polishing table 12 along with the polishing pad 22, and the dresser motor 61 rotates the dressing disk 51 along with the disk holder 52.

In step 10, while the liquid is supplied from the liquid supply nozzle 5 to the polishing surface 23 of the polishing pad 22, the air cylinder 56 lowers the dresser 50 and brings the rotating dressing disk 51 into contact with the polishing surface 23. Pure water is used as the liquid.

In step 11, while the swing motor 65 moves the dresser 50 (including the dressing disk 51) on the polishing surface 23 in the radial direction of the polishing pad 22, the pad height sensor (the surface height measurement instrument) 40 measures the heights of the polishing surface 23 at a plurality of measurement points. The heights of the polishing surface 23 are the distances from the reference plane used in the above step 4 to the dressing disk 51. The measurement values of the heights of the polishing surface 23 are sent to the data processing portion 70.

In step 12, the data processing portion 70 creates the unique pad profile from the measurement values of the heights of the polishing surface 23. The data processing portion 70 stores the obtained unique pad profile in the storage device 70*a*.

In step 13, while the pre-conditioning dressing of the polishing pad 22 is executed, the heights of the polishing surface 23 are measured. Specifically, while the polishing pad 22 and the dressing disk 51 are rotated, and while the swing motor 65 moves the dresser 50 (including the dressing disk 51) in the radial direction of the polishing pad 22, the pad height sensor 40 measures the heights of the polishing surface 23 of the polishing pad 22 at a plurality of measurement points. The heights of the polishing surface 23 are the distances from the reference plane used in the above step 4 to the dressing disk 51. The measurement values of the heights of the polishing surface 23 are sent to the data processing portion 70. When the pre-conditioning dressing of the polishing pad 22 is executed, the liquid such as pure water or the like is supplied from the liquid supply nozzle 5 to the polishing surface 23.

In the pre-conditioning dressing of the above step 13, when the rotating dressing disk 51 is moved on the polishing pad 22, the data processing portion 70 controls the action of the pressure regulator 62 to adjust, based on the difference between the table profile and the unique pad profile, the force with which the air cylinder 56 presses the dressing disk 51 against the polishing surface 23, and makes the pad profile coincident with the table profile.

In step 14, the data processing portion 70 creates the initial pad profile from the measurement values of the heights of the polishing surface 23 which are obtained in step 13. The data processing portion 70 stores the obtained initial pad profile in the storage device 70*a*. After the initial pad profile is created, the liquid is stopped from being supplied to the polishing surface 23, and the rotation of the polishing table 12 and the dresser 50 (including the dressing disk 51) is stopped.

In step 15, the data processing portion 70 corrects the table profile by rotating the table profile until the tilt angle of the table profile is 0. The data processing portion 70 corrects the unique pad profile and the initial pad profile by respectively rotating the unique pad profile and the initial pad profile with the same angle as the tilt angle of the table profile. The direction in which the unique pad profile and the initial pad profile are rotated is the same as the direction in which the table profile is rotated.

In step 16, the data processing portion 70 displays the corrected table profile, the corrected unique pad profile, and the corrected initial pad profile on the display screen 70*c*.

According to the embodiment, the table profile, the unique pad profile, and the initial pad profile are corrected based on the horizontal line. The profile correction using the horizontal line is effectively applied to profile correction in a polishing device including a plurality of polishing tables.

Figure 23:
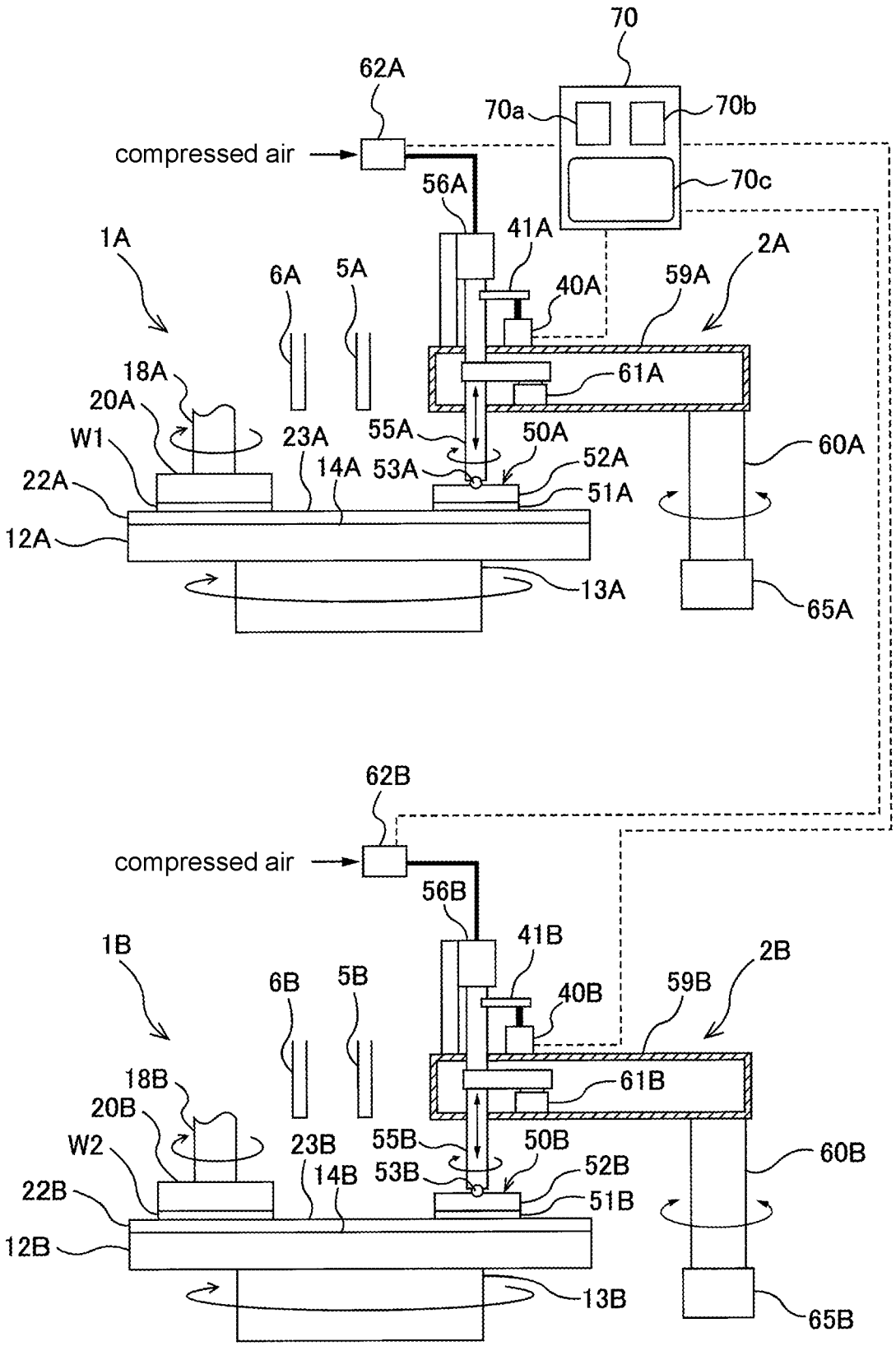
FIG. 23 is a diagram showing one embodiment of a polishing device including a first polishing table, a first dresser, a second polishing table, and a second dresser.

FIG. 23 is a diagram showing one embodiment of a polishing device including a first polishing table 12A, a first dresser 50A, a second polishing table 12B, and a second dresser 50B. In FIG. 23, components corresponding to the components shown in FIG. 1 are represented by the same reference numerals with suffixes A and B, and repeated description of these components is omitted. Each of a first dressing disk 51A and a second dressing disk 51B shown in FIG. 23 is the dressing disk according to any one of the embodiments shown in FIGS. 16-20.

The data processing portion 70 is connected to a first pad height sensor 40A and a second pad height sensor 40B. The first pad height sensor 40A uses the dummy disk 80 to measure heights of a first table surface 14A of the first polishing table 12A, and the second pad height sensor 40B uses the same dummy disk 80 to measure heights of a second table surface 14B of the second polishing table 12B. Then, the data processing portion 70 creates a first table profile of the first polishing table 12A from measurement values of the heights of the first table surface 14A, and creates a second table profile of the second polishing table 12B from measurement values of the heights of the second table surface 14B.

The dummy disk 80 shown in FIGS. 4-8 can remove the liquid present under the dummy disk 80, and thus pad height sensors (surface height measurement instruments) 40A and 40B can accurately measure the heights of the first table surface 14A and the heights of the second table surface 14B. Therefore, the first table profile accurately reflects actual tilt of the first table surface 14A, and the second table profile accurately reflects actual tilt of the second table surface 14B.

A first unique pad profile and a first initial pad profile are created from measurement values of heights of a polishing surface 23A which are obtained using the first dressing disk 51A, and a second unique pad profile and a second initial pad profile are created from measurement values of heights of a polishing surface 23B which are obtained using the second dressing disk 51B. Similar to the dummy disks 80, the first dressing disk 51A and the second dressing disk 51B can remove the liquid present under the dressing disks 51A and 51B, and thus the pad height sensors (the surface height measurement instruments) 40A and 40B can accurately measure the heights of the polishing surface 23A of a first polishing pad 22A and the heights of the polishing surface 23B of a second polishing pad 22B. Therefore, the first unique pad profile and the first initial pad profile accurately reflect an actual height distribution of the polishing surface 23A of the first polishing pad 22A, and the second unique pad profile and the second initial pad profile accurately reflect an actual height distribution of the polishing surface 23B of the second polishing pad 22B.

After a wafer W1 is polished on the first polishing pad 22A, the polishing surface 23A of the first polishing pad 22A is dressed by the first dressing disk 51A so that the pad profile is coincident with the first table profile. Similarly, after a wafer W2 is polished on the second polishing pad 22B, the polishing surface 23B of the second polishing pad 22B is dressed by the second dressing disk 51B so that the pad profile is coincident with the second table profile.

Usually, a rotation axis of the first polishing table 12A and a rotation axis of the second polishing table 12B are not parallel to each other due to mechanical errors at the time of assembling. As a result, the tilt of the first table surface 14A and the tilt of the second table surface 14B, that is, the first table profile and the second table profile are not the same. However, as described above, the pad profile of the first polishing pad 22A is controlled based on the first table profile, and the pad profile of the second polishing pad 22B is controlled based on the second table profile. In other words, the pad profile of the first polishing pad 22A and the pad profile of the second polishing pad 22B are independently controlled. Therefore, regardless of the tilt of the first table surface 14A and the second table surface 14B, the pad profile of the first polishing pad 22A and the pad profile of the second polishing pad 22B can be managed in the same manner.

Particularly, the dummy disk 80 enables accurate surface height measurement in which the effect of the liquid is eliminated, and thus a difference of a measurement environment between the first polishing table 12A and the second polishing table 12B can be eliminated. Similarly, the first dressing disk 51A and the second dressing disk 51B enable accurate surface height measurement in which the effect of the liquid is eliminated, and thus a difference of a measurement environment between the first polishing pad 22A and the second polishing pad 22B can be eliminated. Therefore, the polishing device can control the wafer polishing in the same manner in the first polishing table 12A and the second polishing table 12B.

The first table profile and the second table profile are corrected based on the above-described common horizontal line. The correction of the first table profile based on the horizontal line is executed according to the processes shown in the flowcharts shown in FIG. 21 and FIG. 22. The correction of the second table profile based on the horizontal line is basically performed in the same manner.

More specifically, the process for correcting the second table profile includes a process in which the second polishing table 12B and the dummy disk 80 (see FIGS. 4-8) which is fixed to the second disk holder 52B of the second dresser 50B are rotated; the dummy disk 80 is brought into contact with the second table surface 14B while the liquid is supplied to the second table surface 14B of the second polishing table 12B; the heights of the second table surface 14B are measured at a plurality of measurement points while the dummy disk 80 is moved on the second table surface 14B; the second table profile showing the tilt of the second table surface 14B is created from the measurement values of the heights of the second table surface 14B; a tilt angle of the second table profile from the above horizontal line is calculated; and the second table profile is corrected by rotating the second table profile until the tilt angle of the second table profile is 0. The creation of the second table profile and the correction of the second table profile are performed by the data processing portion 70.

Furthermore, the data processing portion 70 creates the first unique pad profile and the first initial pad profile of the first polishing pad 22A according to the method described in the above embodiment, and rotates the first unique pad profile and the first initial pad profile with the same angle as the tilt angle of the first table profile from the above horizontal line to correct the first unique pad profile and the first initial pad profile. The data processing portion 70 displays the corrected first table profile, the corrected first unique pad profile, and the corrected first initial pad profile on the display screen 70*c*.

Similarly, the data processing portion 70 creates the second unique pad profile and the second initial pad profile of the second polishing pad 22B according to the method described in the above embodiment, and rotates the second unique pad profile and the second initial pad profile with the same angle as the tilt angle of the second table profile from the above horizontal line to correct the second unique pad profile and the second initial pad profile. The data processing portion 70 displays the corrected second table profile, the corrected second unique pad profile, and the corrected second initial pad profile on the display screen 70*c*.

Figure 24A:
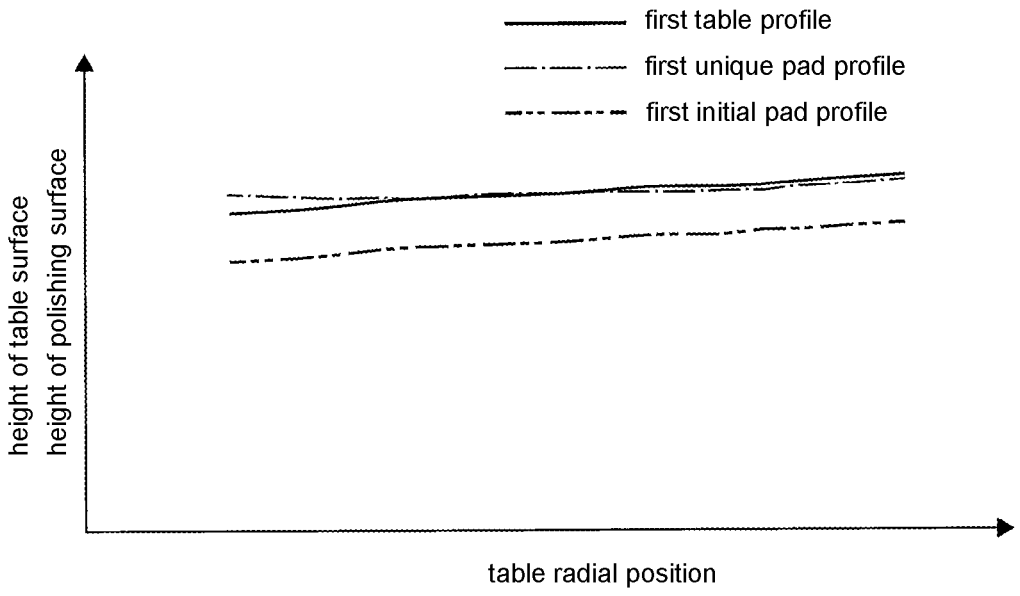
FIG. 24A is a diagram showing the first table profile, the first unique pad profile, and the first initial pad profile before being corrected.
Figure 24B:
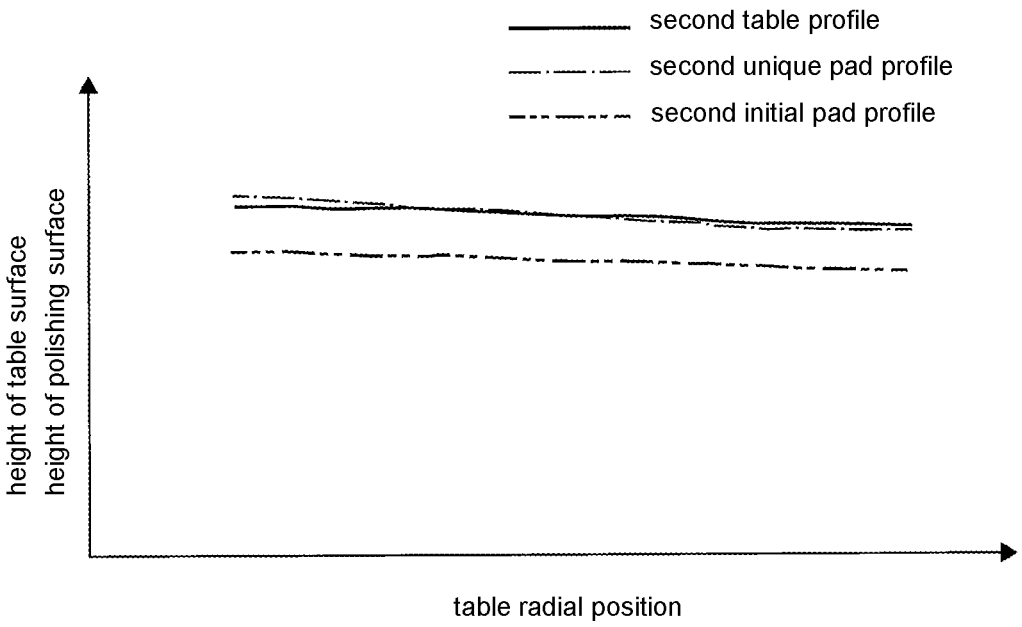
FIG. 24B is a diagram showing the second table profile, the second unique pad profile, and the second initial pad profile before being corrected.

FIG. 24A is a diagram showing the first table profile, the first unique pad profile, and the first initial pad profile which are displayed on the display screen 70*c* before being corrected, and FIG. 24B is a diagram showing the second table profile, the second unique pad profile, and the second initial pad profile which are displayed on the display screen 70*c* before being corrected. As shown in FIG. 24A and FIG. 24B, tilt of the first table profile before being corrected is different from tilt of the second table profile before being corrected. As a result, tilt of the first initial pad profile before being corrected is different from tilt of the second initial pad profile before being corrected.

Figure 25A:
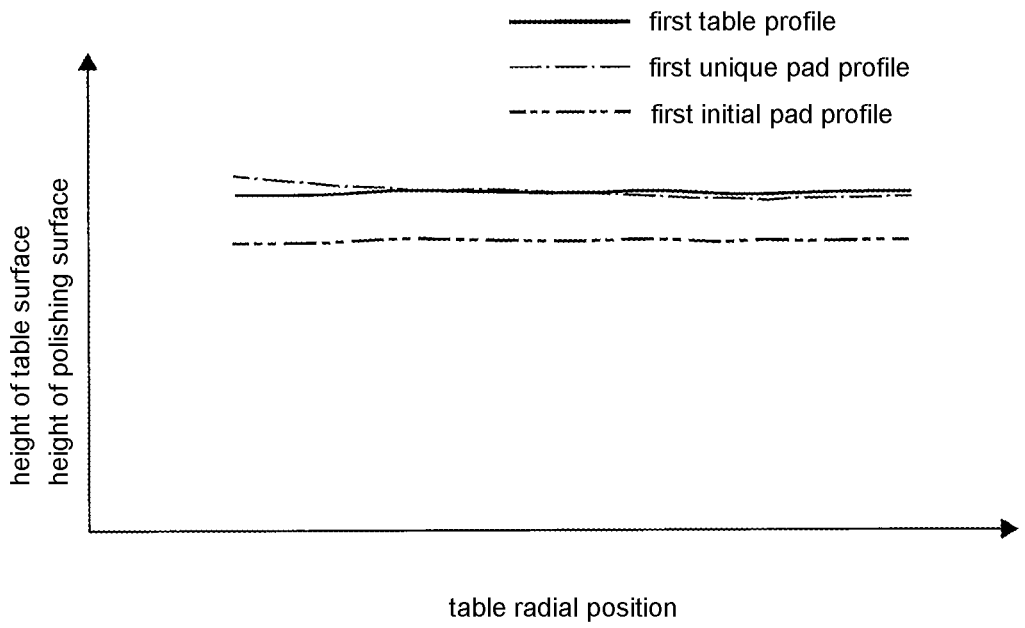
FIG. 25A is a diagram showing a corrected first table profile, a corrected first unique pad profile, and a corrected first initial pad profile.
Figure 25B:
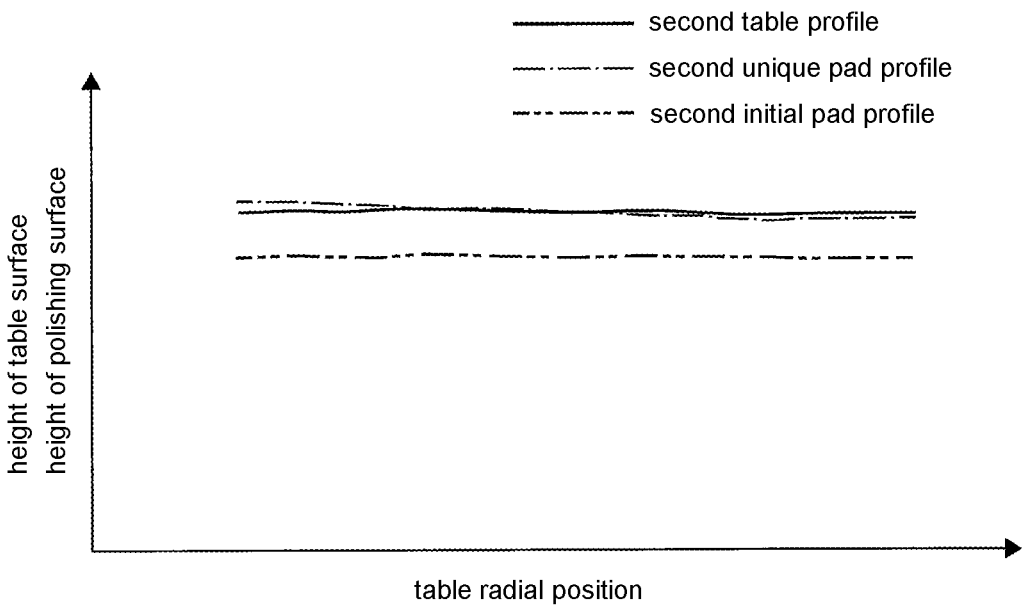
FIG. 25B is a diagram showing a corrected second table profile, a corrected second unique pad profile, and a corrected second initial pad profile.

FIG. 25A is a diagram showing the corrected first table profile, the corrected first unique pad profile, and the corrected first initial pad profile which are displayed on the display screen 70*c*, and FIG. 25B is a diagram showing the corrected second table profile, the corrected second unique pad profile, and the corrected second initial pad profile which are displayed on the display screen 70*c*. As shown in FIG. 25A and FIG. 25B, tilt of the corrected first table profile is substantially the same as tilt of the corrected second table profile. As a result, tilt of the corrected first initial pad profile is very close to tilt of the corrected second initial pad profile.

As known from FIG. 25A and FIG. 25B, according to the embodiment, the first table profile and the second table profile are corrected based on the common horizontal line, and thus there is substantially no difference between the first table profile and the second table profile. Furthermore, there is substantially no difference between the first initial pad profile and the second initial pad profile too.

Other Configurations

The disclosure provides a dummy disk which enables a surface height measurement instrument to accurately measure the heights of the table surface of the polishing table. In addition, the disclosure provides a dressing disk which enables a surface height measurement instrument to accurately measure the heights of the polishing surface of the polishing pad. Furthermore, the disclosure provides a method in which the heights of the table surface of the polishing table is measured using the above dummy disk.

In one aspect, a dummy disk is provided which is fixed to a disk holder of a dresser when heights of a table surface of a polishing table are measured. The dummy disk includes a first surface capable of coming into contact with the disk holder; and a second surface which is on an opposite side of the first surface. The second surface has a plurality of liquid discharge channels, and the plurality of liquid discharge channels extends from one end of the second surface to the other end.

In one aspect, the plurality of liquid discharge channels is a plurality of grooves.

In one aspect, the plurality of grooves is a plurality of straight grooves arranged in parallel to each other.

In one aspect, the plurality of liquid discharge channels is a plurality of first grooves and a plurality of second grooves intersecting the plurality of first grooves.

In one aspect, the plurality of second grooves is perpendicular to the plurality of first grooves.

In one aspect, the plurality of liquid discharge channels is uniformly distributed over the entire second surface.

In one aspect, an area of the liquid discharge channels occupies 40%-81% of an area of the entire second surface.

In one aspect, a dressing disk is provided which is fixed to a disk holder of a dresser when a polishing surface of a polishing pad is dressed. The dressing disk includes a first surface capable of coming into contact with the disk holder; and a second surface which is on an opposite side of the first surface. The second surface has a plurality of protrusion portions and a plurality of liquid discharge channels positioned between the plurality of protrusion portions, the plurality of liquid discharge channels extends from one end of the second surface to the other end, and abrasive grains are fixed to surfaces of the plurality of protrusion portions.

In one aspect, the plurality of liquid discharge channels is a plurality of grooves.

In one aspect, the plurality of grooves is a plurality of straight grooves arranged in parallel to each other.

In one aspect, the plurality of liquid discharge channels is a plurality of first grooves and a plurality of second grooves intersecting the plurality of first grooves.

In one aspect, the plurality of second grooves is perpendicular to the plurality of first grooves.

In one aspect, the plurality of liquid discharge channels is uniformly distributed on the entire second surface.

In one aspect, an area of the liquid discharge channels occupies 40%-81% of an area of the entire second surface.

In one aspect, a method is provided to include steps of rotating a polishing table and the dummy disk; bringing the dummy disk into contact with a table surface of the polishing table while a liquid is supplied to the table surface; measuring heights of the table surface at a plurality of measurement points while the dummy disk is moved on the table surface; and creating a table profile showing tilt of the table surface from measurement values of the heights of the table surface.

In the one aspect, the method further includes: calculating a tilt angle of the table profile from a horizontal line; and correcting the table profile by rotating the table profile until the tilt angle is 0.

In the one aspect, the method further includes: rotating the polishing pad arranged on the table surface along with the polishing table, and rotating the dressing disk; bringing the dressing disk into contact with a polishing surface of the polishing pad while a liquid is supplied to the polishing surface; measuring heights of the polishing surface at a plurality of measurement points while the dressing disk is moved on the polishing surface; and creating an initial pad profile showing a height distribution of the polishing surface from measurement values of the heights of the polishing surface.

In the one aspect, the method further includes: correcting the initial pad profile by rotating the initial pad profile by an angle the same as the tilt angle, wherein a direction in which the initial pad profile is rotated is the same as a direction in which the table profile is rotated.

In the one aspect, the method further includes: displaying the corrected table profile and the corrected initial pad profile on a display screen.

In the one aspect, the polishing table, the table surface, and the table profile are respectively a first polishing table, a first table surface, and a first table profile; and the method further includes: steps of rotating a second polishing table and the dummy disk; bringing the dummy disk into contact with a second table surface of the second polishing table while a liquid is supplied to the second table surface; measuring heights of the second table surface at a plurality of measurement points while the dummy disk is moved on the second table surface; creating a second table profile showing tilt of the second table surface from measurement values of the heights of the second table surface; calculating a tilt angle of the second table profile from the horizontal line; and correcting the second table profile by rotating the second table profile until the tilt angle of the second table profile is 0.

The dummy disk having a plurality of liquid discharge channels is unlikely to be affected by the presence of the liquid on the table surface, and the posture of the dummy disk is stabilized. As a result, the surface height measurement instrument can accurately measure the heights of the table surface and can obtain an accurate table profile.

The dressing disk having a plurality of liquid discharge channels is unlikely to be affected by the presence of the liquid on the polishing surface, and the posture of the dressing disk is stabilized. As a result, the surface height measurement instrument can accurately measure the heights of the polishing surface, and can obtain an accurate pad profile.

The above-described embodiments are described for a purpose that those who have ordinary knowledge in the technical field to which the disclosure belongs can implement the disclosure. Various modifications of the above embodiments can be naturally made by those skilled in the art, and the technical idea of the disclosure can also be applied to other embodiments. Therefore, the disclosure is not limited to the embodiments that are described, and is interpreted in the widest scope according to the technical idea defined by the scope of claims.

What is claimed is:

1. A method, performing by a data processing portion, comprising:

making a polishing table and a dummy disk rotate;

bringing the dummy disk into contact with a table surface of the polishing table while a liquid is supplied to the table surface;

measuring heights of the table surface at a plurality of measurement points while the dummy disk is moved on the table surface;

creating a table profile showing tilt of the table surface from measurement values of the heights of the table surface;

calculating a tilt angle of the table profile with respect to a horizontal line that is a virtual line indicating a horizontal direction of the polishing table;

correcting the table profile by that the data processing portion make the table profile rotate with respect to the horizontal line until the tilt angle is 0°;

rotating the polishing pad arranged on the table surface along with the polishing table, and rotating the dressing disk;

bringing the dressing disk into contact with a polishing surface of the polishing pad while the liquid is supplied to the polishing surface;

measuring heights of the polishing surface at a plurality of measurement points while the dressing disk is moved on the polishing surface; and creating an initial pad profile showing a height distribution of the polishing surface from measurement values of the heights of the polishing surface, wherein the dummy disk is fixed to a disk holder of a dresser when the heights of the table surface of the polishing table are measured, the dummy disk comprises:

a first surface capable of coming into contact with the disk holder; and a second surface which is on an opposite side of the first surface, wherein the second surface has a plurality of liquid discharge channels, and the plurality of liquid discharge channels extends from one end of the second surface to the other end, wherein the dressing disk is fixed to the disk holder of the dresser when the polishing surface of the polishing pad is dressed, and the dressing disk comprises:

a first surface capable of coming into contact with the disk holder; and a second surface which is on an opposite side of the first surface of the dressing disk, wherein the second surface of the dressing disk has a plurality of protrusion portions and the plurality of liquid discharge channels positioned between the plurality of protrusion portions, the plurality of liquid discharge channels extends from one end of the second surface to the other end, and abrasive grains are fixed to surfaces of the plurality of protrusion portions.

2. The method according to claim 1, further comprising:

correcting the initial pad profile by that the data processing portion make the initial pad profile rotate with respect to the horizontal line by an angle the same as the tilt angle in which the table profile is rotated.

3. The method according to claim 2, further comprising:

displaying the corrected table profile and the corrected initial pad profile on a display screen.

4. A method, performing by a data processing portion, comprising:

making a first polishing table and a dummy disk rotate;

bringing the dummy disk into contact with a first table surface of the first polishing table while a liquid is supplied to the first table surface;

measuring heights of the first table surface at a plurality of measurement points while the dummy disk is moved on the first table surface;

creating a first table profile showing tilt of the first table surface from measurement values of the heights of the first table surface;

calculating a tilt angle of the first table profile with respect to a horizontal line that is a virtual line indicating a horizontal direction of the polishing table;

correcting the first table profile by rotating the first table profile until the tilt angle is 0;

rotating a second polishing table and the dummy disk;

bringing the dummy disk into contact with a second table surface of the second polishing table while the liquid is supplied to the second table surface;

measuring heights of the second table surface at a plurality of measurement points while the dummy disk is moved on the second table surface;

creating a second table profile showing tilt of the second table surface from measurement values of the heights of the second table surface;

calculating a tilt angle of the second table profile with respect to the horizontal line; and correcting the second table profile by rotating the second table profile until the tilt angle of the second table profile is 0°, wherein the dummy disk is fixed to a disk holder of a dresser when heights of the first table surface of the polishing table are measured, the dummy disk comprises:

a first surface capable of coming into contact with the disk holder; and a second surface which is on an opposite side of the first surface of the dummy disk, wherein the second surface dummy disk has a plurality of liquid discharge channels, and the plurality of liquid discharge channels extends from one end of the second surface to the other end.

* * * * *